US007814698B2

(12) United States Patent
Fluhr et al.

(10) Patent No.: US 7,814,698 B2
(45) Date of Patent: Oct. 19, 2010

(54) CONNECTING PIECES FOR WEAPON RAILS

(75) Inventors: Norbert Fluhr, Oberndorf (DE); Wolfgang Bantle, Oberndorf (DE); Johannes-August Bantle, Bosingen (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 12/510,717

(22) Filed: Jul. 28, 2009

(65) Prior Publication Data

US 2010/0005697 A1 Jan. 14, 2010

Related U.S. Application Data

(63) Continuation of application No. PCT/EP2008/000731, filed on Jan. 30, 2008.

(30) Foreign Application Priority Data

Feb. 1, 2007 (DE) ..... 10 2007 005 142

(51) Int. Cl.
*F41G 1/40* (2006.01)

(52) U.S. Cl. ..... 42/127; 42/124; 42/111; 42/148

(58) Field of Classification Search ..... 42/111, 42/124–128, 148
See application file for complete search history.

(56) References Cited

U.S. PATENT DOCUMENTS 2,545,419 A * 3/1951 Williams ..... 42/127

(Continued)

FOREIGN PATENT DOCUMENTS

DE 708101 7/1941

(Continued)

OTHER PUBLICATIONS

"PCT International Preliminary Report of Patentability," issued by the International Bureau on Sep. 17, 2009, in connection with International Application No. PCT/EP2008/000731, 10 pages.

(Continued)

*Primary Examiner*—Michelle Clement
(74) *Attorney, Agent, or Firm*—Hanley, Flight & Zimmerman, LLC

(57) ABSTRACT

A connecting piece couplable to a rail of a weapon is described. An example connecting pieces includes a first retaining element including a first receiving region configured to engage a corresponding first counterface of the rail. The example connecting piece also includes a second retaining element including a second receiving region configured to engage a corresponding second counterface of the rail. In addition, the example connecting piece includes a guide slot running diagonally to a longitudinal direction of the rail via which the first retaining element and the second retaining elements are coupled. When one of the two retaining elements is displaced in the longitudinal direction of the rail, at least one of the first retaining element or the second retaining element moves obliquely relative to the other of the first retaining element or the second retaining element following the orientation of the guide slot to move the connecting piece between a working position in which the first receiving region is engaged with the corresponding first counterface and the second receiving region is engaged with the second counterface to a release position in which both the first receiving region and the second receiving region are no engaged with the corresponding first counterface and the second counterface, respectively.

42 Claims, 23 Drawing Sheets

U.S. PATENT DOCUMENTS

| | | | | |
|---|---|---|---|---|
| 4,008,536 | A * | 2/1977 | Adams | 42/112 |
| 4,021,954 | A * | 5/1977 | Crawford | 42/127 |
| 4,383,371 | A * | 5/1983 | Coffey | 42/124 |
| 5,375,361 | A * | 12/1994 | Rustick | 42/125 |
| 5,680,725 | A * | 10/1997 | Bell | 42/127 |
| 6,442,883 | B1 * | 9/2002 | Waterman et al. | 42/124 |
| 6,449,893 | B2 * | 9/2002 | Spinner | 42/127 |
| 6,606,813 | B1 | 8/2003 | Squire et al. | |
| 7,107,716 | B1 | 9/2006 | Liao | |
| 7,647,720 | B1 * | 1/2010 | Vendetti | 42/126 |
| 7,685,759 | B2 * | 3/2010 | Teetzel | 42/127 |
| 2004/0128900 | A1 | 7/2004 | Chen et al. | |
| 2006/0156609 | A1 | 7/2006 | Kim | |
| 2007/0169393 | A1 * | 7/2007 | Frost | 42/124 |
| 2008/0034638 | A1 * | 2/2008 | Spuhr | 42/127 |

FOREIGN PATENT DOCUMENTS

| | | |
|---|---|---|
| DE | 19918635 | 7/2000 |
| DE | 20002859 | 7/2000 |
| DE | 102004007916 | 9/2005 |
| GB | 116166 | 6/1918 |

OTHER PUBLICATIONS

"PCT Written Opinion and International Search Report," German language, issued by the International Bureau on Jun. 30, 2008, in connection with International Application No. PCT/EP2008/000731, 9 pages.

"PCT Written Opinion and International Search Report," English Translation of German language Written Opinion and International Search Report, issued by the International Bureau on Jun. 30, 2008, in connection with International Application No. PCT/EP2008/000731, 9 pages.

* cited by examiner

CONNECTING PIECES FOR WEAPON RAILS

RELATED APPLICATIONS

This patent is a continuation of International Patent Application Serial No. PCT/EP2008/000731, filed Jan. 30, 2008, which claims priority to German Patent Application 10 2007 005 142.7, filed on Feb. 1, 2007, both of which are hereby incorporated herein by reference in their entireties.

FIELD OF DISCLOSURE

This disclosure relates generally to firearms, and, more particularly, to a connecting pieces that are couplable to rails of weapons.

BACKGROUND

Traditionally, various special sighting devices, for example sniperscopes, telescopic sights, laser sights etc. are firmly mounted on a weapon, for example using screw mechanisms. In addition, there are also known fastening elements for fastening of weapons add-on units on weapons. For example U.S. Pat. No. 7,107,716 shows a carrier element for weapons accessories in the style of a quick change system. The carrier element includes profiles that engage in a Picatinny rail and are expandable at a right angle to the rail. A lateral spring-loaded pivot lever is arranged on the carrier element that clamps the fastening element on the Picatinny rail like a clamp.

In another example, U.S. Pat. No. 6,606,813 shows engagement profiles for fastening elements movably arranged in a guide rail for fastening on a Picatinny rail. Here the locking takes place via an eccentric connected to a pivot lever.

German Patent DE 199 186 35 C1 describes an assembly device with a case having two parts movable to each other and transversely to the axis of the bore of the weapon. The parts are movably loaded against one another by a spring arrangement in such a way that solely their loading as a result of the spring arrangement produces their engagement between a longitudinal mounting channel on a weapon and the mounting base. The spring force is negotiable by compression of the two parts for neutralization of the engagement. Such an arrangement can be sensitive to violent ricochets and disengage from the weapon without additional interlocking.

From G9116166 a wedge arrangement is known which forms a clamping block whose strength is adjustable by two wedge elements sliding against each other, wherein the adjustment action is applied via a screw pushing through both wedge elements. This clamping device is used to fasten plates of different strength in slotted hollow profiles. This device is not suitable as a fastening element for fastening of weapons add-on devices.

Additionally, U.S. Patent Publication 2004/0128900 A1 shows a fastening apparatus for add-on units on a small arm. The fastening apparatus is fastened by means of a bolt or lever spring-loaded in transverse direction on a profiled rail, for example a Picatinny rail. Also, U.S. Patent Publication 2006/0156609 shows several variants for fastening a fastening element on a profiled rail or a Picatinny rail in vise-like manner using screw elements.

In yet another example, German Patent DE 200 02 859 U1 shows a sight rail with adjustable locking lever. For fastening the sight rail on or removing the sight rail from a profiled rail, the locking lever is screwed away from or to the profiled rail by means of a threaded bolt in transverse direction.

In addition, some hunting weapons include swivel mountable rear sight notches. The front sight is usually constructed rigidly. For assembly line produced weapons, for example automatic weapons or the like, firmly mounted sighting devices are known that are sometimes designed to swivel in and out.

In the military sector, rear sight notches often are designed as simple, more or less vertical plates with a sight notch that must be brought to a line of sight with a front sight. The use of swiveling sighting devices and sometimes lateral or in the height adjustable sighting devices are known. The rear sight notch is frequently constructed as a sliding rear sight, in which the rear sight leaf is mounted on a sliding rear sight base plate, which can be adjusted in height to the respective range of firing.

In another example, German Patent DE 708101 (Walther) discloses a pivoting sight with multiple adjustable and interchangeable rear sight plates as well as a rough and fine height adjustment of the sighting device. The adjustment of the sights takes place via a spring-loaded screw spindle with locking slots. The lateral adjustment of the sighting device takes place with the help of screw and retaining bolts arranged oppositely. Preferred screw positions are fixed via ball catches.

Also with hunting weapons, the front sight is usually firmly mounted on the front end of the barrel on a front sight base. In the military sector, the front sight is also screwed or otherwise rigidly fastened on the system box or a mounting rail. In the case of the American M16, the front sight is mounted on a distant base because the sight diopter is arranged in a high carry handle. In the case of the more modern AR 15, this carry handle can be removed and instead of this fit on a mounting rail, wherein then the front sight and the front sight base are removed.

From German Patent DE 10 2004 007 916 A1, a weapon with a mounting rail for the addition of add-on units is known, in which the front sight and the rear sight notch are designed to pivot in the mounting rail.

Known connecting pieces for the fastening of add-on devices have the disadvantage that usually additional tools are required for their fastening on a profiled rail and the assembly is laborious.

Known sighting devices often have to be elaborately and usually rigidly fastened. Thus in the case of hunting weapons the open sight becomes useless when a telescopic sight is attached over an assembly because the assembly device collides with the open sight.

In the military sector, often the rear sight and the front sight must be removed for the addition of add-on devices, for example a sighting device because otherwise the add-on device cannot be fit on a fastening rail, such as for example a Picatinny rail. In the case of pivotable sights an exact guiding and arrangement of the pivotable front sight and its notch is not always ensured. However, the guiding and arrangement of the pivotable front sight and its notch is required to maintain the desired sighting and aiming accuracy.

DETAILED DESCRIPTION

Positional terms used herein such as above, below, front, rear, right and left refer from the view of a marksman holding a weapon in a normal, ready-to-fire firing position with a horizontal barrel. The example connecting pieces described herein are arranged on a mounting rail running parallel to the axis of the bore.

Some examples described herein relate to an example connecting piece for fixing on a profiled rail of a weapon. The example connecting piece includes retaining elements that can be moved between a working position and a release position. The retaining elements engage with corresponding receiving regions of the profiled rail in the working position and disengage the receiving regions of the profiled rail when the connecting piece is in the release position.

Some examples described herein relate to an example connecting piece including an example sight with an adjustment element that can be moved in opposition to a spring force from a sight position into an adjustment position.

Some examples described herein further relate to an example connecting piece including a second example sight that can be mounted directly on a hand guard of a weapon and can be pivoted between an unused position and a working position.

Figure 1:
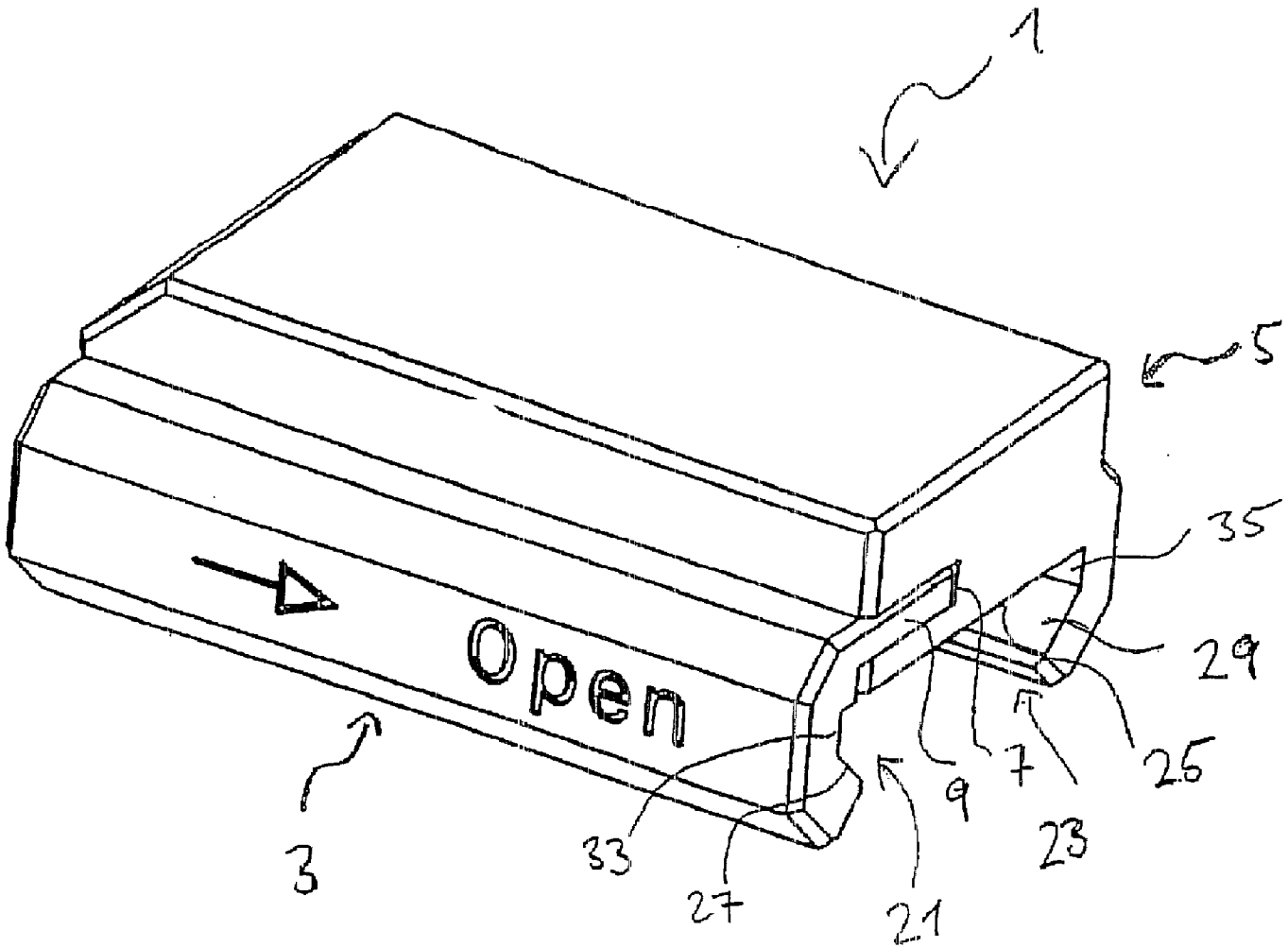
FIG. 1 is a perspective view diagonally from the rear of an example connecting piece.

FIG. 1 shows an example fastening element or connecting piece 1 diagonally from the front. The example connecting piece 1 includes a first retaining element 3 and a second retaining element 5. The first retaining element 3 has a clip-like projection 9 that runs in a slot-shaped recess 7 in the second retaining element 5. Both the first and second retaining elements 3, 5 are longitudinally displaceable with respect to each other in the direction of the arrow shown in FIG. 1.

Figure 3:
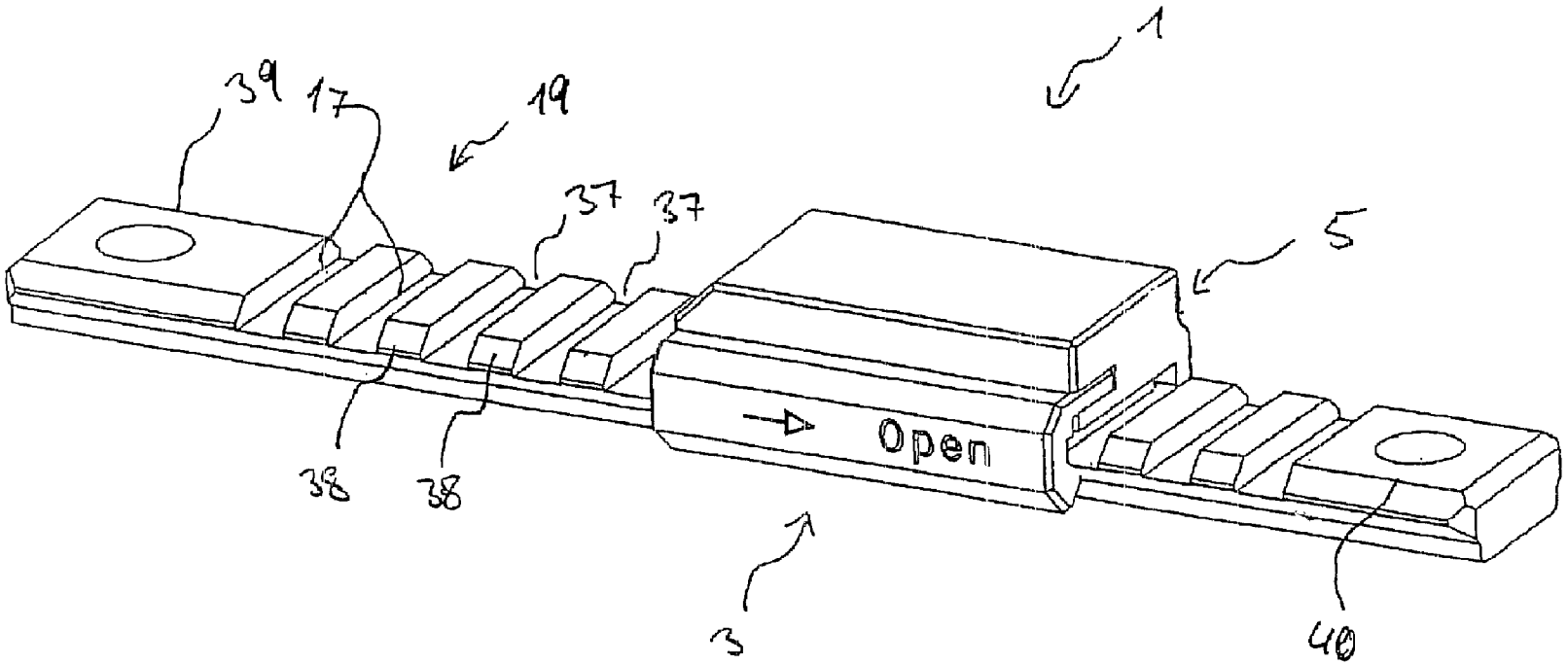
FIG. 3 is a perspective view from the top left of the example connecting piece of FIG. 1 fastened to an example weapon rail.

In addition, the example connecting piece 1 includes a handle 12 (shown in block form in FIG. 4) for moving on the second retaining element 5. A spring element 13 (FIG. 4) is located within the connecting piece 1. The connecting piece 1 can be placed upon a profiled rail 19 of a weapon (FIG. 3). To enable the connecting piece 1 to be coupled to the rail 19, the first retaining elements has a first receiving region 21 and the second retaining element 5 has a second receiving region 23.

Figure 6:
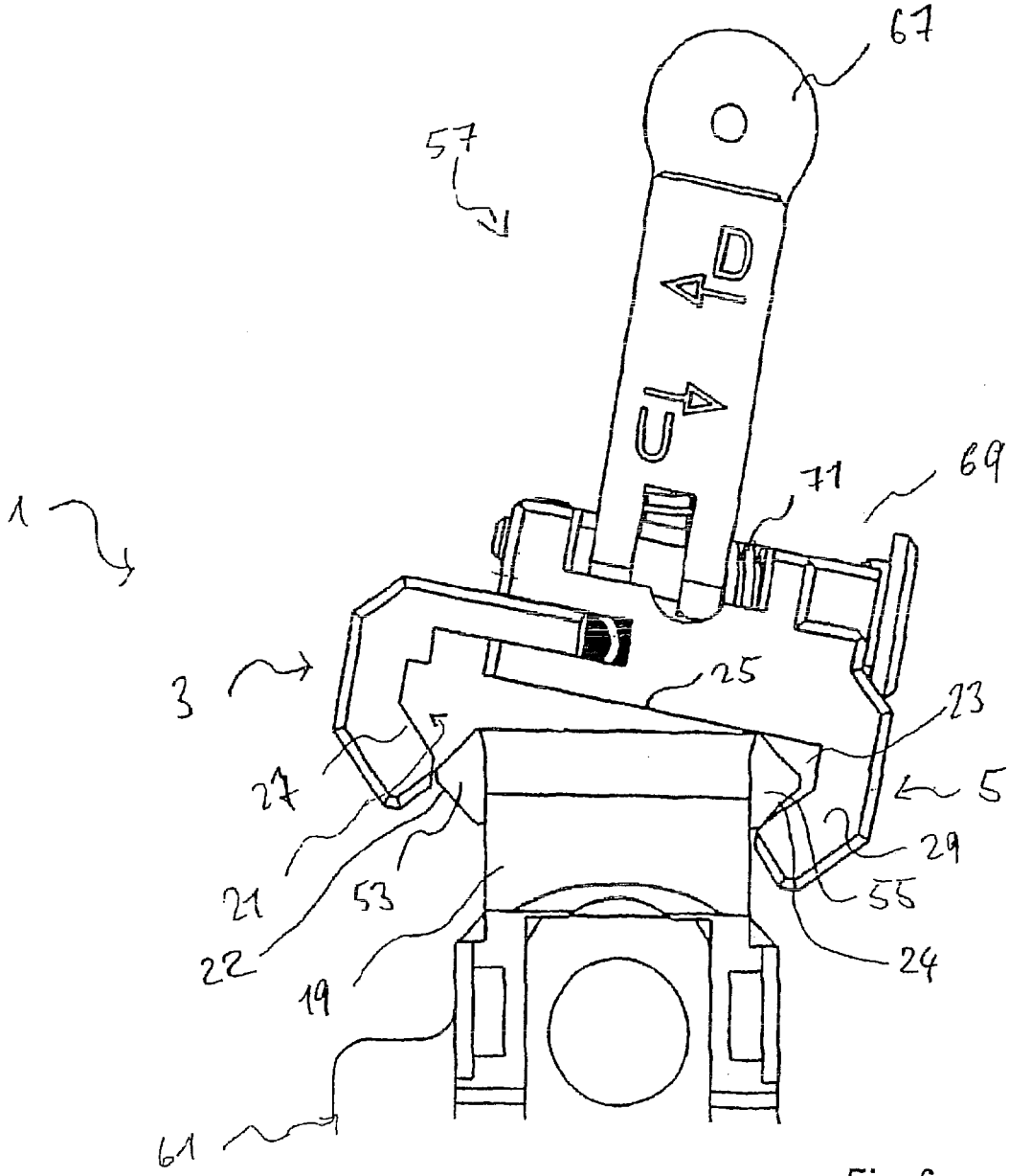
FIG. 6 is a rear view of the example connecting piece in the release position with an example sight in a working/sight position.

A first wedge-shaped segment 27 of the first receiving region 21 and a first linear running segment 33 are located on the underside 25 of the receiving region 21. The second retaining element 5 includes a second wedge-shaped segment 29 as well as a second linear running segment 35. The first and second wedge-shaped segments 27, 29 encompass counterfaces 22, 24 (FIGS. 6 and 7) of the profiled rail 19 when being placed upon the rail 19 forming corresponding receiving regions in dovetailed manner. The segments 27, 29 come into contact with the flat surfaces of the counterfaces 22, 24 on the profiled rail 19 (FIG. 6). In other examples, the segments 27, 29 or the profiled rail 19 may be constructed so a point contact or line contact takes place between the elements 1 and 19.

Figure 2:
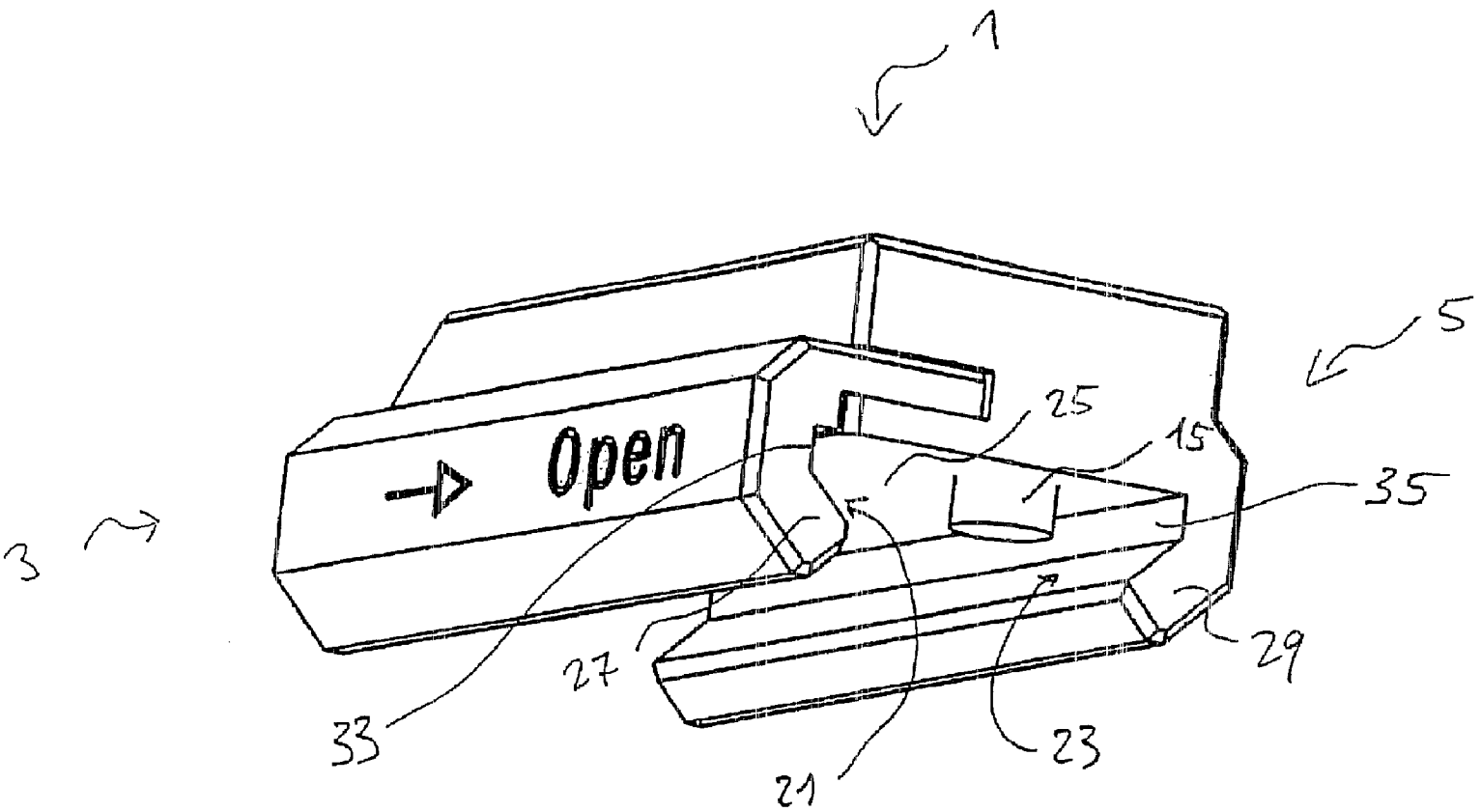
FIG. 2 is a perspective view diagonally from below of the example connecting piece of FIG. 1.

As shown in FIG. 2, on the underside 25 of the connecting piece 1 there is a projection 15 that engages into a transverse slot 37 (FIGS. 3 and 4) of the profiled rail 19. The projection 15 serves as counter-formation and fixes the connecting piece 1 in longitudinal direction. In this example, the projection 15 is constructed as a bolt, which can be inserted into a corresponding receiving opening 18 on the second retaining element 5 (FIGS. 4 and 5).

FIG. 3 shows the example connecting piece 1 fastened on a profiled rail 19 such as, for example, a Picatinny rail. The Picatinny rail 19 can be used for fastening on a weapon 61 (FIG. 6) or also on other objects. The rail 19 has a front fastening region 39 as well as a rear fastening region 40, by means of which the rail 19 can be fixed with suitable fastening elements (not shown), for example bolts. Between the first and the second fastening regions 39 and 40, transverse slots 37 run between projections 38 at regular intervals. When the connecting piece 1 is placed on the Picatinny rail 19, the projection 15 (FIG. 2) engages in one of the transverse slots 37 on the Picatinny rail 19 and is fixed on the Picatinny rail 19 in longitudinal direction. In some examples, in addition to or alternatively to the transverse slot 37, a borehole with corresponding radius can be constructed. In the case of an eccentrically arranged borehole lateral to the longitudinal axis, the connecting piece 1 may be slipped on only in the correct orientation to the front or rear on the profiled rail 19. If the diameter of the borehole and of the bolt 15 is greater than the width of the transverse slot 37, the connecting piece 1 may also be slipped on only in a specified position in longitudinal direction, which may be advantageous when the connecting piece 1 includes sights.

Figure 4:
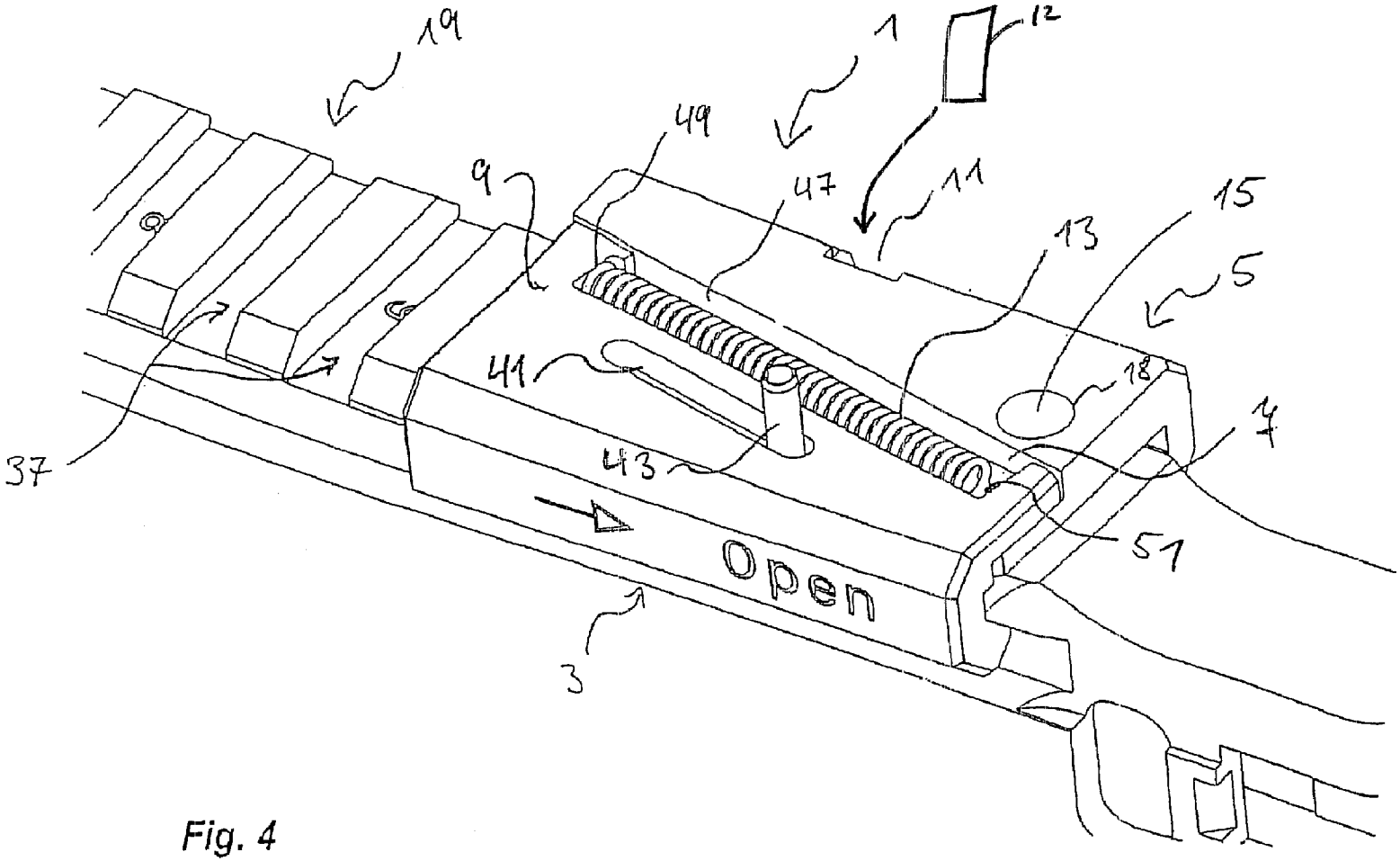
FIG. 4 is a sectional view of the example connecting piece of FIG. 3 with exposed example link mimicking means.
Figure 5:
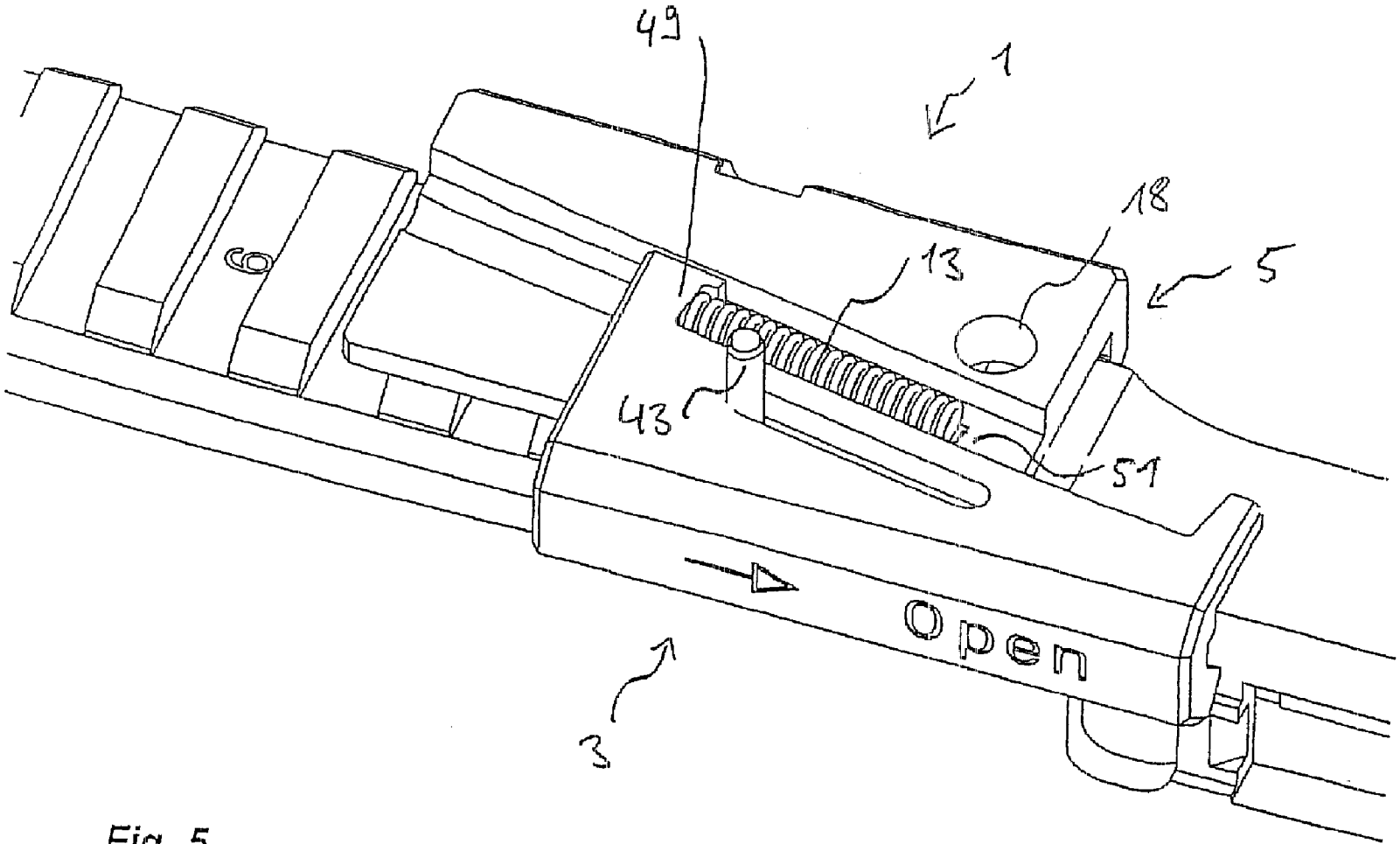
FIG. 5 is a sectional view of the example connecting piece of FIG. 4 in an example release position.

Further in FIG. 4, the circular receiving opening 18 of the second retaining element 5 is shown. In addition, the projection is shown schematically, which is in engagement with the Picatinny rail 19. During manufacturing, the projection 15 can be placed into an opening or into a recess after production. Further, the projection 15 can be constructed as a bolt or firmly connected to the retaining element 5 or attached on the retaining element 5.

To remove the connecting piece 1 from the Picatinny rail 19, both the first and second retaining elements 3 and 5 are moved with the handle 12 against each other in longitudinal direction. Example opening mechanism(s) are illustrated in FIGS. 4-7.

As shown in FIG. 4, a diagonally running guide slot 41 is included in the first retaining element 3. A guide element 43 protrudes from the second retaining element 5 into the guide slot 41. In this example the guide element 43 is constructed as a guide cam 43. The spring 13 runs parallel to the guide slot 41 in a recess 47 serving as a spring guide and acts between a front stop 49 in the first retaining element 3 and a rear stop 51 in the second retaining element (see also FIG. 5). The stops 49, 51 are constructed here as projections that act on the ends of a helical compression spring 13. The spring 13 is stabilized and guided by the boundaries of the recess 47 running parallel to the guide slot 41.

The second retaining element 5 has a rectangular recess 11 on the right, on which the handle 12 can be arranged.

Further, as shown in FIG. 4, the diagonal course of the clip-like projection 9 of the first retaining element 3 is shown, the projection 9 protruding into the slot-like recess 7 in the second retaining element 5. The guide cam 43 is coupled to the second retaining element 5 on its ends and pushes through the guide slot 41 and the slot-like recess 7. Within the guide slot 41, the first retaining element 3 is movably arranged in longitudinally displaceable manner opposite the second retaining element 5 and is guided by the guide cam 43 in its longitudinal movement (compare FIG. 5).

FIG. 5 shows the example connecting piece 1 of FIG. 4 arranged upon the Picatinny rail 19 and in an opened state. The first retaining element 3 is moved against the second retaining element 5 in longitudinal direction. The guide cam 43 is located in contact with the rear end of the guide slot 41. A further opening movement is not possible. The spring 13 acts against the opening movement and pushes the first retaining element 3 in the direction of its original position. The rear stop 51 of the recess 47 is exposed. A bolt or a projection of other type can be arranged on the boundaries 49 and 51 in a longitudinal direction parallel to the recess 47 to protrude into the interior of the spring for stabilization.

Additionally or alternatively to the projection 15 shown in FIG. 2, the opening or recess 18 may be exposed and able to receive the projection or bolt 15. The projection or bolt 15 is fastened, for example, by means of an interference fit or also by means of adhesives or welding or other fastening methods. In the opened state, the connecting piece 1 can be removed from or placed upon the Picatinny rail 19, as FIGS. 6 and 7 show.

FIG. 6 shows the example connecting piece 1 in a release position (compare FIG. 5) in the case of being placed upon or removed from a profiled rail or Picatinny rail 19. The connecting piece 1 is provided with a swiveled out sight 57. FIG. 7 shows the example connecting piece 1 of FIG. 6 in the release position and placed upon a Picatinny rail 19, wherein the first retaining element 3 is moved against the second retaining element 5 in longitudinal direction. The two retaining elements 3 and 5, due to the diagonal slotted guide of the guide slot 41, are also laterally offset against one another. This lateral displacement is sufficient to place the connecting piece 1 around projections 53, 55 on the Picatinny rail 19. For this purpose the wedge-shaped segment 29 of the second retaining element 5 goes into engagement with the projections 55 of the Picatinny rail 19 and is in contact with the counterfaces 24 of the projection 55. The underside 25 of the connecting piece 1 goes on the Picatinny rail 19 and achieves its positive connection as shown in FIG. 7. Inclination and length of the slotted guide are set in such a way that, in the release position, the inside diameter between the wedge-shaped segments 27, 29 is sufficient to place or remove the connecting piece 1 above the projections 53, 55.

The inclination of the guide slot 41 is such that it acts self-locking in transverse direction, i.e., the retaining elements 3, 5 are only movable in longitudinal direction. The angle of inclination ranges between 7° and 15°. Transverse forces acting on the connecting piece 1 have no influence on the fixation. The orientation in longitudinal direction is selected in such a way that longitudinal forces in a preferred direction (e.g. recoil forces) support the closing effect of the spring 13, i.e. act as additional fixing or fastening.

Figure 7:
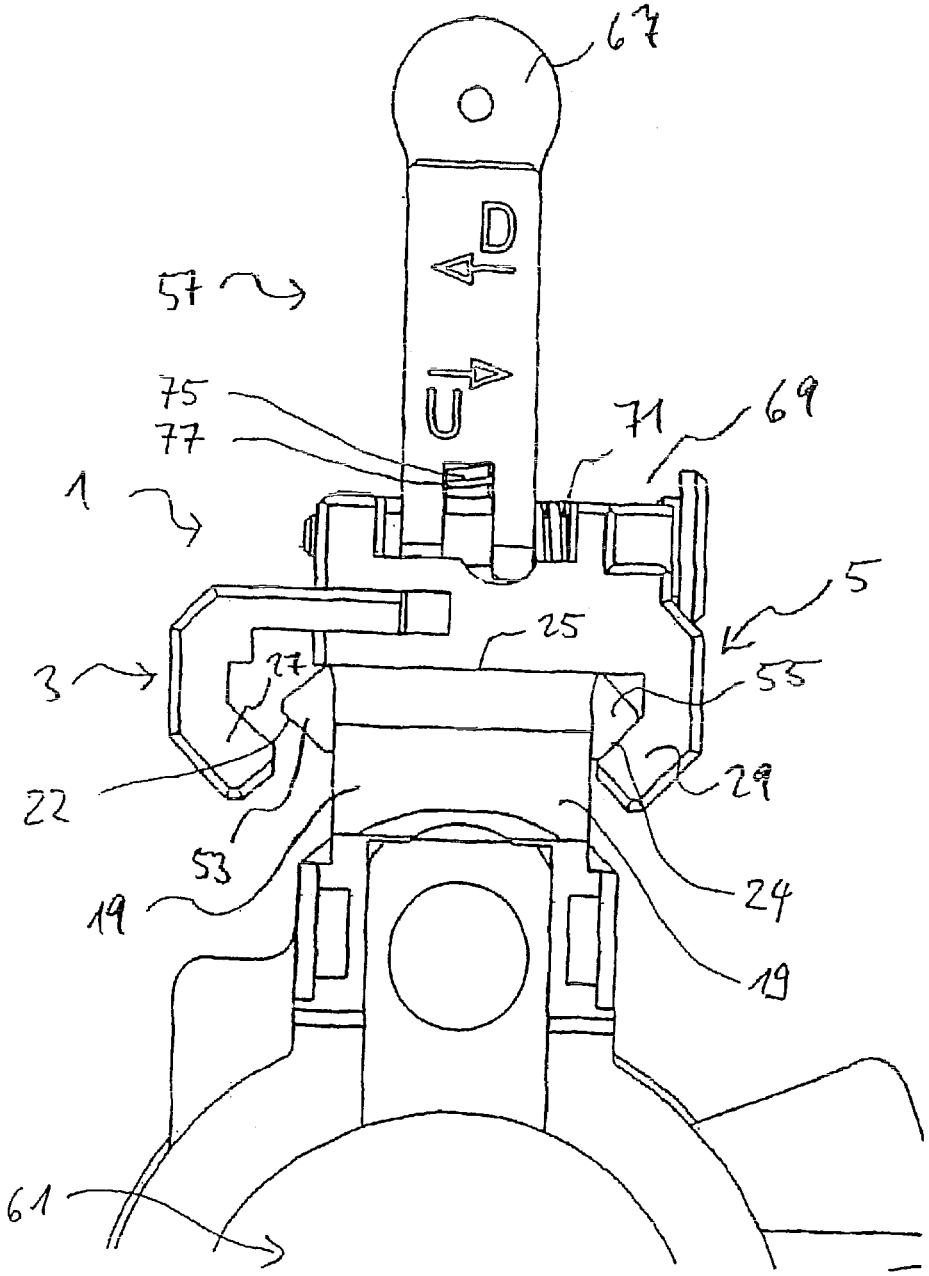
FIG. 7 is a side view of the example connecting piece of FIG. 6 in an example opened, fitted state on the example weapon rail.

After the relegating of the two retaining elements 3 and 5 to their unused position (compare FIGS. 1-4), the spring 13 relaxes and, with the reversal of the transverse offset of the two retaining elements 3 and 5 to each other, the receiving region 21 shown spaced apart in FIG. 7 joins the counterface 22 of the projection 53 of the Picatinny rail 19. Furthermore, the projection 15 is in engagement with a recess 37 (compare FIG. 2) so that no longitudinal displacement of the connecting piece 1 is possible. The guide cam 43 is spaced from the rear end of the guide slot 41 to guarantee tolerance compensation in mounted state.

In addition in FIGS. 6 and 7, an example sight 57 is arranged on the example connecting piece 1. Also, a rudimentary reproduced weapon 61 is shown on which the Picatinny rail 19 is mounted, for example, on a housing of a hand guard assembly.

The example sight 57 includes a handle 67 on its upper end that is constructed as a rear sight notch and a second adjustment element 69 for lateral adjustment. The second adjustment element 69 is surrounded by a spring element 71 and forms a pivoting axis or adjustment axis for the sight 57.

In FIG. 7 shows the sight 57 is swiveled up and out (i.e., in a working position) and can be swiveled down and to the rear (compare FIG. 8) around a pivoting axis constructed as an adjustment axis (i.e., to an unused position). The example sight 57 includes a locking element 73 (compare FIG. 13) for locking the sight 57 in the working and unused positions. To move the sight 57 from one position to the other, the sight 57 is swiveled against a spring force acting on the sight 57 via the locking element 73.

Further, the sight 57 includes a first adjustment element 75 that enables height adjustment of the sight 57. In FIG. 7, the first adjustment element 75 is only partially visible and is surrounded by a spring element 77 (compare FIG. 9).

Figure 8:
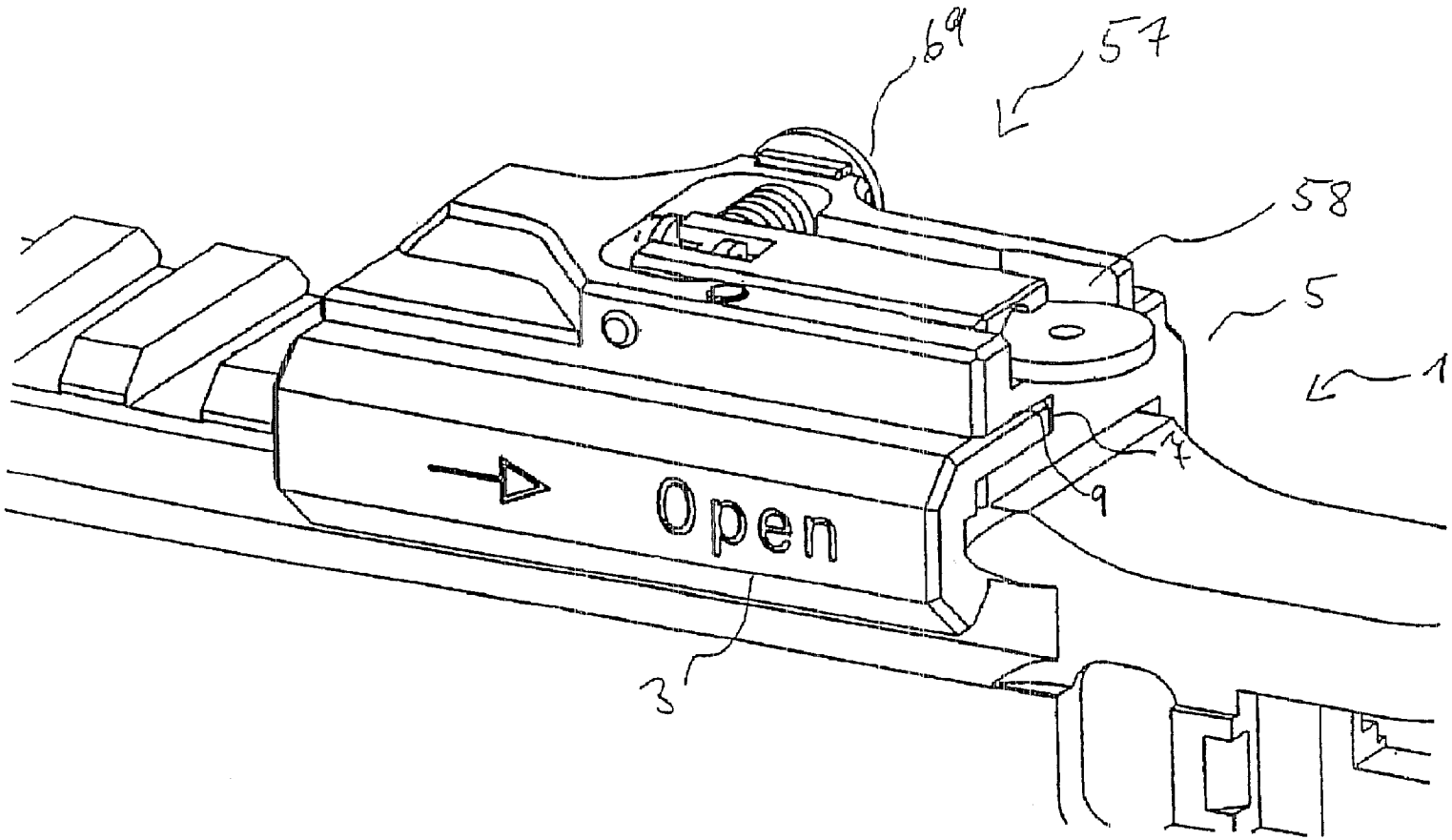
FIG. 8 is a perspective view of the example connecting piece of FIG. 6 in an example working position with the example sight in an unused position.

FIG. 8 shows the connecting piece 1 of FIG. 6 in the working position with the sight 57 swiveled in (i.e., in the unused position), in which the sight 57 is arranged within an opening or recess 58 in the top side of the connecting piece 1. When the sight 57 is swiveled in to the unused position, the rear side of the sight 57 is in contact with the connecting piece 1.

Figure 9:
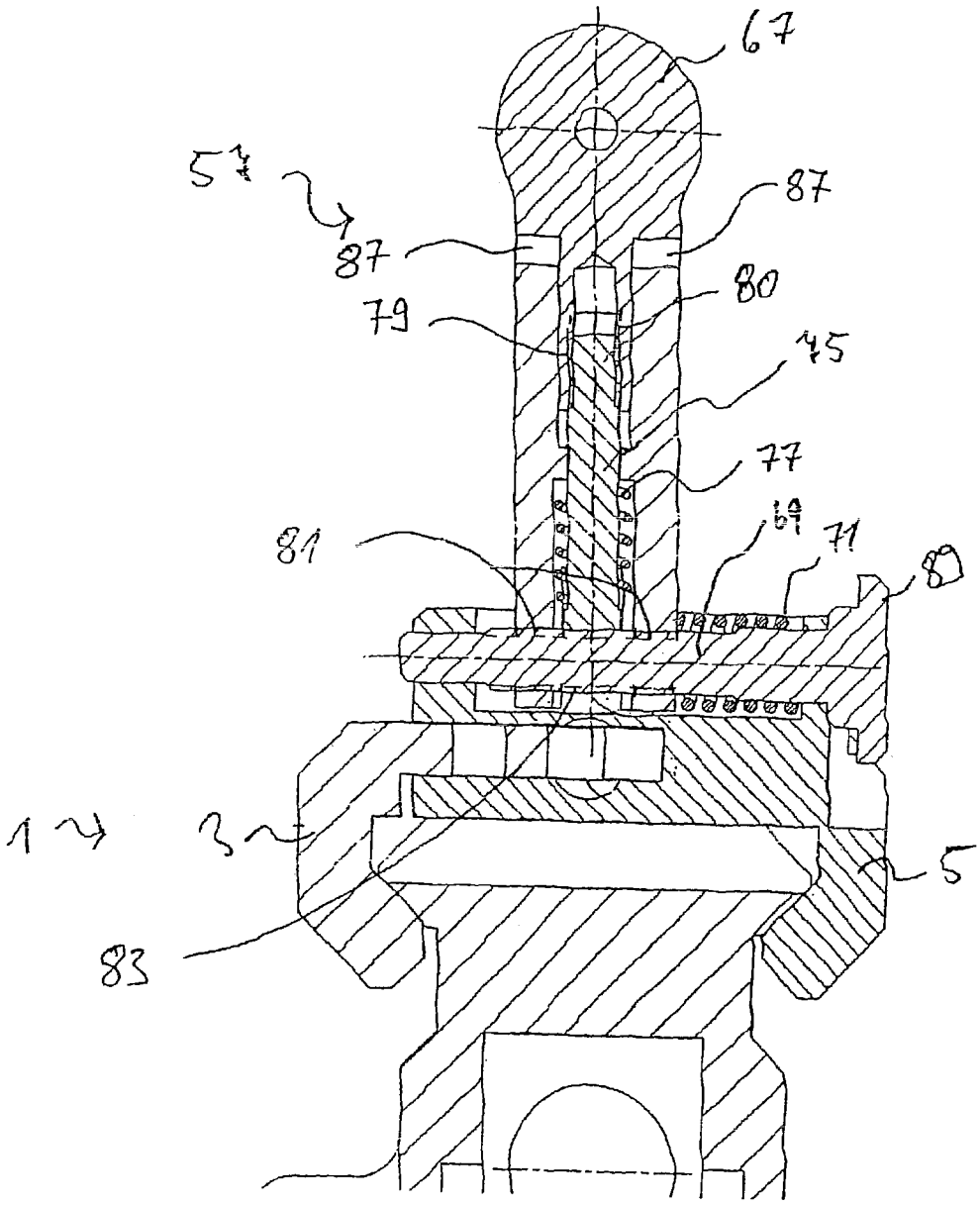
FIG. 9 is a cross-sectional view through the example arrangement of FIG. 1 with the connecting piece in working position.

FIG. 9 shows the sight 57 swiveled out (i.e., in the working position). In a hollow space of the swiveled-out sight 57, the first adjustment element 75 for height adjustment is surrounded by the helical compression spring 77. An external threaded section 79 of the first adjustment element 75 is coupled above a corresponding internal threaded section 80 in the handle constructed as a rear sight notch 67.

Figure 10:
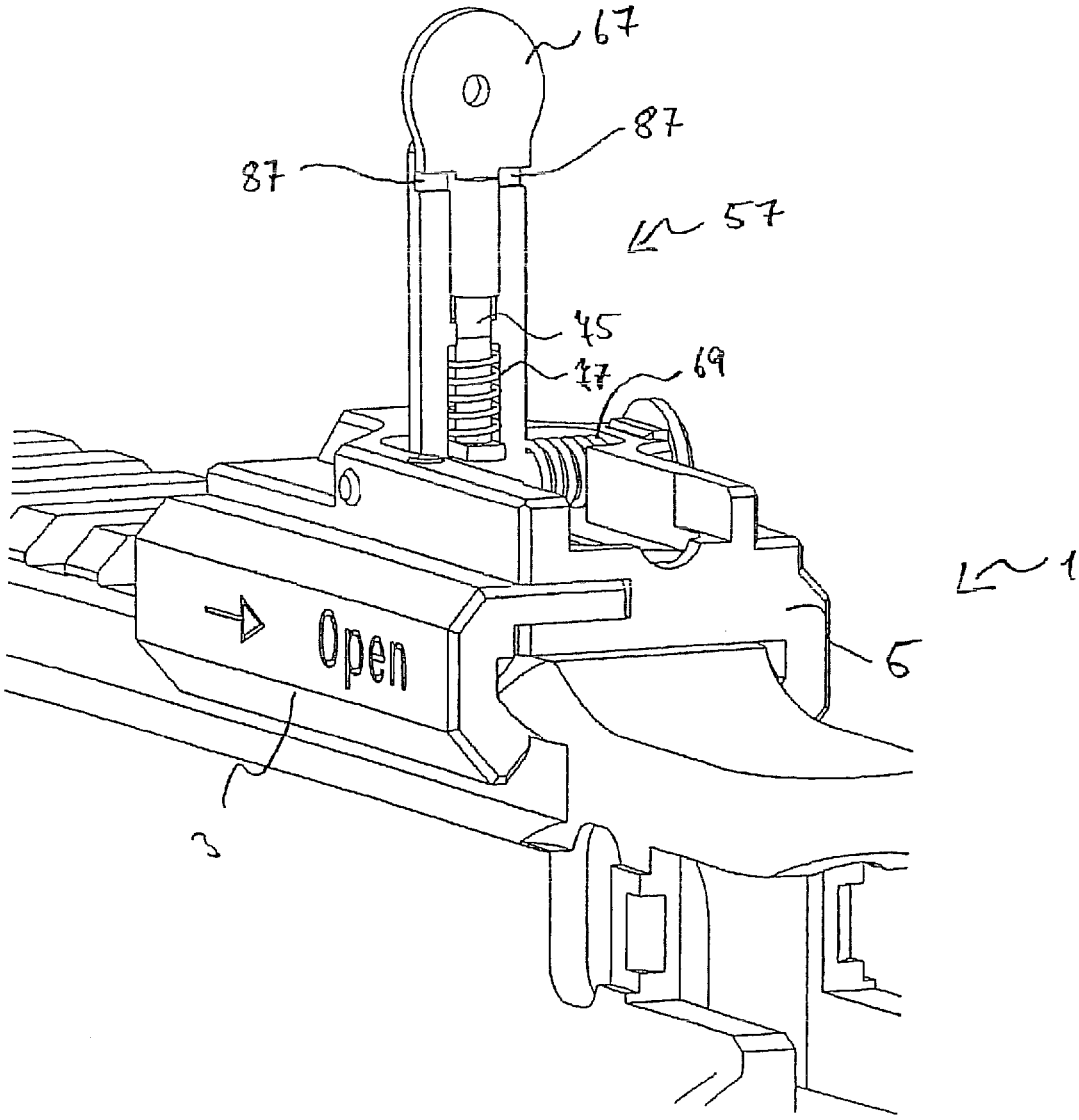
FIG. 10 is a perspective view of the example arrangement of FIG. 9 with partially exposed sight.

FIG. 10 shows the swiveled-out sight 57 with the adjustment element 75 exposed. The external threaded section 79 cooperates with the internal threaded section 80 on the rear sight notch 67 for height adjustment (see also FIG. 12).

Figure 11:
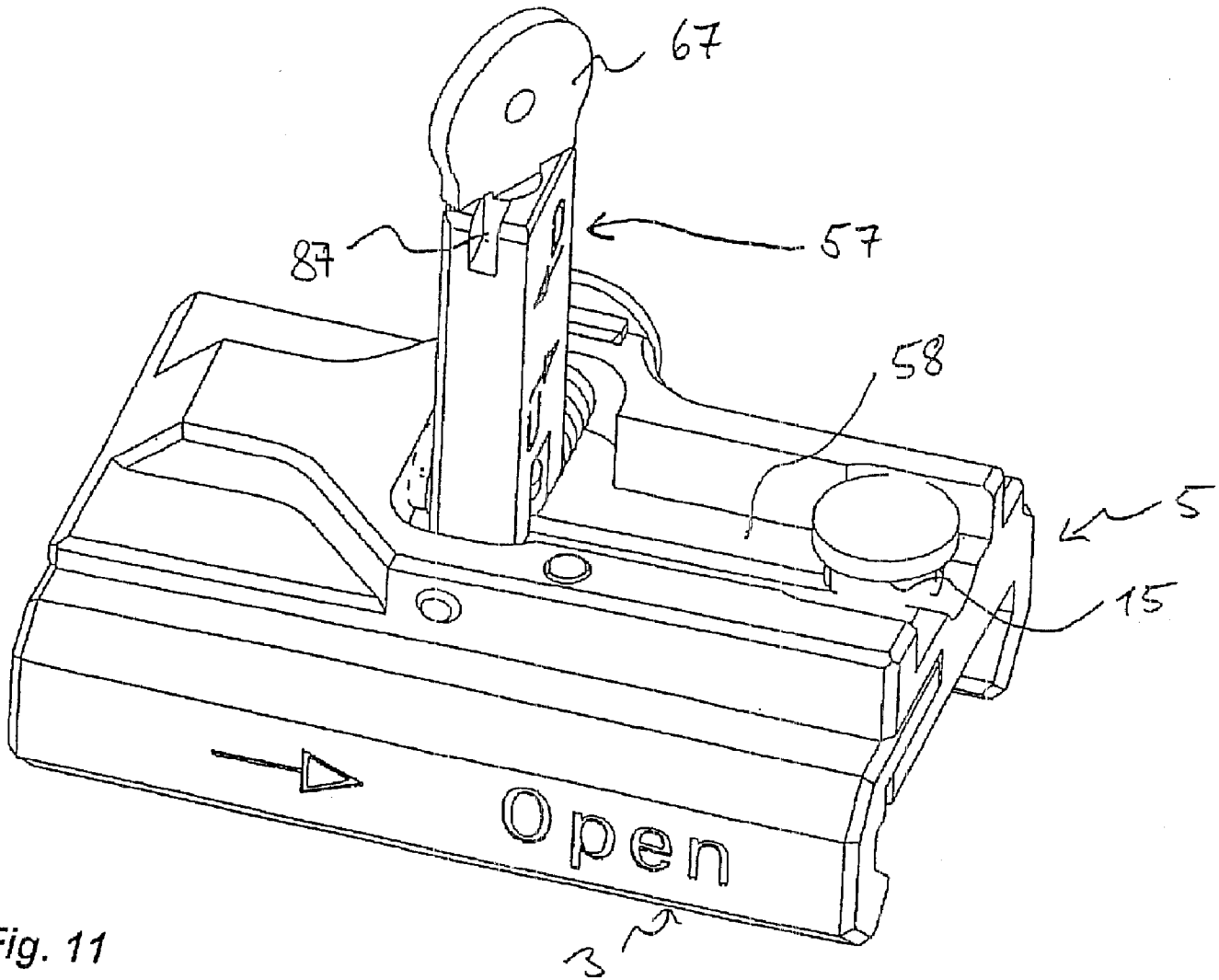
FIG. 11 is a perspective view of an example connecting piece with an example sight with an example handle released from a locking position.

FIG. 11 shows the rear sight notch 67 slightly turned. On the upper end of the sight 57 there are recesses 87 running transversely to the axis of the bore 106 (see FIG. 19). The recesses are arranged opposite one another at both sides of the shaft region of the rear sight notch 67. The rear sight notch 67 is spring-loadedly seated in these recesses 87. When the rear sight notch 67 is at least partially extracted from the sight 57, both recesses are cleared and the rear sight notch 67 is freely rotatable. The rear sight notch 67 may then be turned on the threaded section 83 either clockwise or counter-clockwise (screwed in or out) for height adjustment.

In addition, in FIG. 11, in the recess 58, in which the sight 57 can be swiveled in, a bolt 15, which is not completely inserted, is shown.

Figure 12:
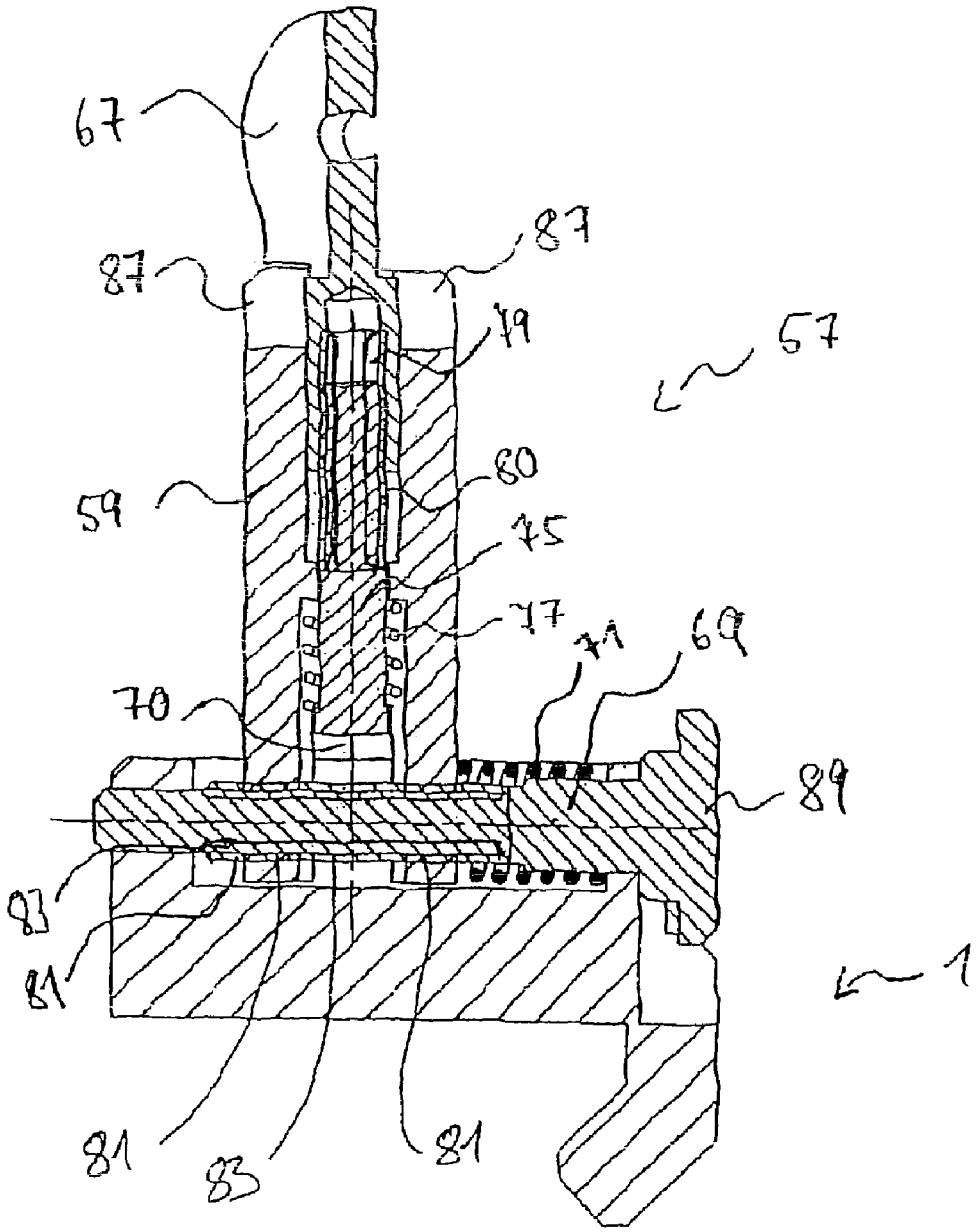
FIG. 12 is a sectional view of the example arrangement of FIG. 1.

In FIG. 12, the rear sight notch 67 is again shown partially laterally rotated or turned. In the sight 57, the first adjustment element 75 for height adjustment runs in longitudinal direction at the upper end of the threaded section 79, which cooperates for height adjustment with a counter-threaded section 80. A torsion of the rear sight notch 67 causes a rotation of the threaded section 79 against the counter-threaded section 80 and, hence, a linear adjustment of the rear sight notch 67 either upward or downward.

The lower end of the first adjustment element 75 is spring-loadedly seated on the second adjustment element 69. If the rear sight notch 67 is pulled upward, the rear sight notch 67 can be rotated. By means of a turning of the sight 57 by 180° around the first adjustment element 75, the height of the sight 57 is adjustable by specified increments, for example from a 100 m distance to a 150 m distance or in a fine adjustment to a specified distance. The height adjustment is cancelled by an inverse turning. After turning of the rear sight notch 67 by 180°, the rear sight notch 67 is withdrawn from the spring element 77 of the sight 57.

Figure 15:
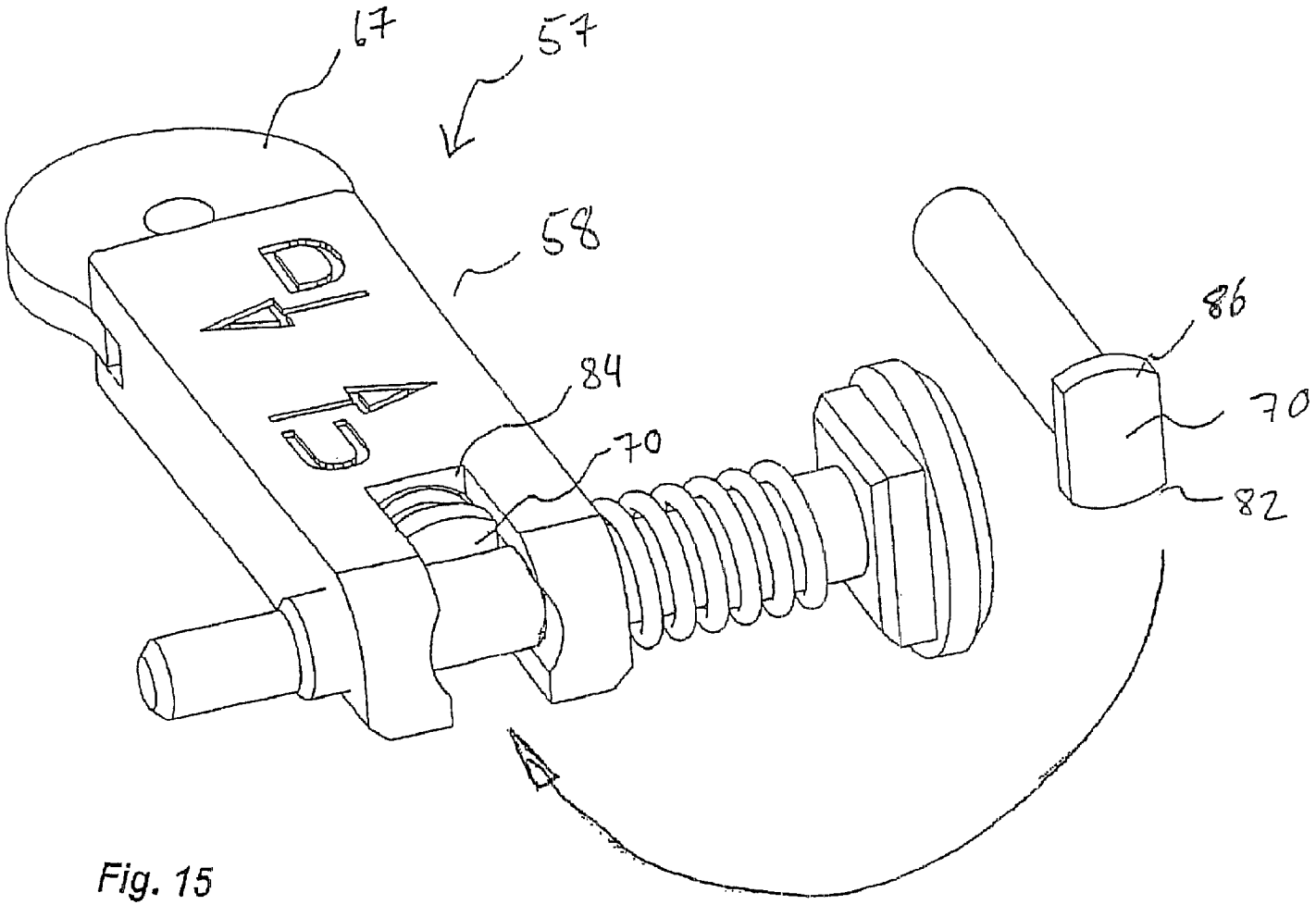
FIG. 15 is a perspective detailed view of the example mechanism for lateral adjustment.

The first adjustment element 75 is linearly displaceably arranged in a sight body 59 and is secured from being pulled out by means of a base plate 70. Front and rear base plate regions 82, 86 (FIG. 15) protrude into a guide slot and secure the adjustment element 75 from rotation. The spring element 77 supports itself between the base plate 70 and an inside wall 84 in the sight body 57. The spring element 77 holds the rear sight notch 67 above the first adjustment element 75 and the threaded coupling in the recesses 87 and prevents an unintentional adjustment (see also FIG. 15).

The second adjustment 69 extends transversely to the first adjustment element 75. The second adjustment element 69 is loaded with the spring element 71 and forms a handle 89. If the second adjustment element 69 is pulled out on the handle 89 against the spring action from the connecting piece 1 (FIG. 14) and brought to its adjustment position, lateral adjustment of the sight 57 is possible. To enable lateral adjustment, a front section of the second adjustment element 69 includes an external threaded section 83 that cooperates with a counter-threaded sections 81 in the sight body 59 (compare FIGS. 12 and 13). If the second adjustment element 69 is rotated (and the threaded section 83 rotates against the counter-threaded sections 81), the sight body 59 and, thus, the sight 57 are linearly adjusted to the left or the right. The torsion takes place by fixed, defined amounts so that a desired line of sight can be set with a front sight (not shown).

Figure 13:
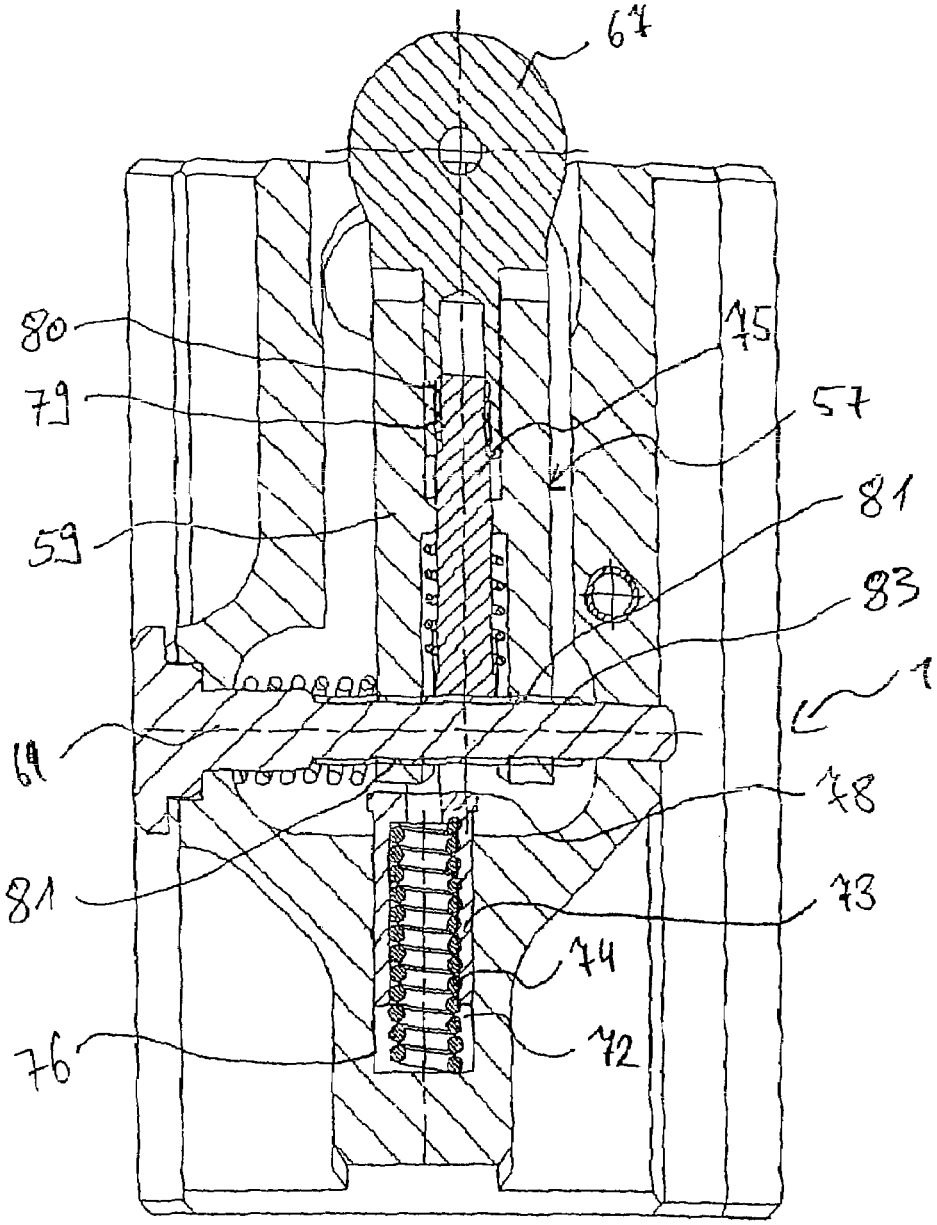
FIG. 13 is another sectional view of the example arrangement of FIG. 11 with the sight in unused position.

FIG. 13 illustrates the effect of an example locking element 73 tensioned by an example spring element 74. The spring element 74, in this example, is constructed as a helical compression spring. The locking element 73 holds the sight 57 in its respective pivoting position. When the sight 57 is swiveled, the locking element 73 pushes, with the locking base 78 and the spring load, against the lower region of the sight body 59. The friction action produced inhibits the pivoting mobility of the sight body 59 and, thus, of the sight 57. Flat surfaces on the sight body 59 define preferred pivoting positions, namely the unused position, in which the sight 57 fits folded on its holding fixture (FIGS. 8, 13, 17, 18), and the working position, in which the sight 57 protrudes out, is swiveled out or folded out from the holding fixture (FIGS. 6, 7, 9-12, 14, 16).

Figure 17B:
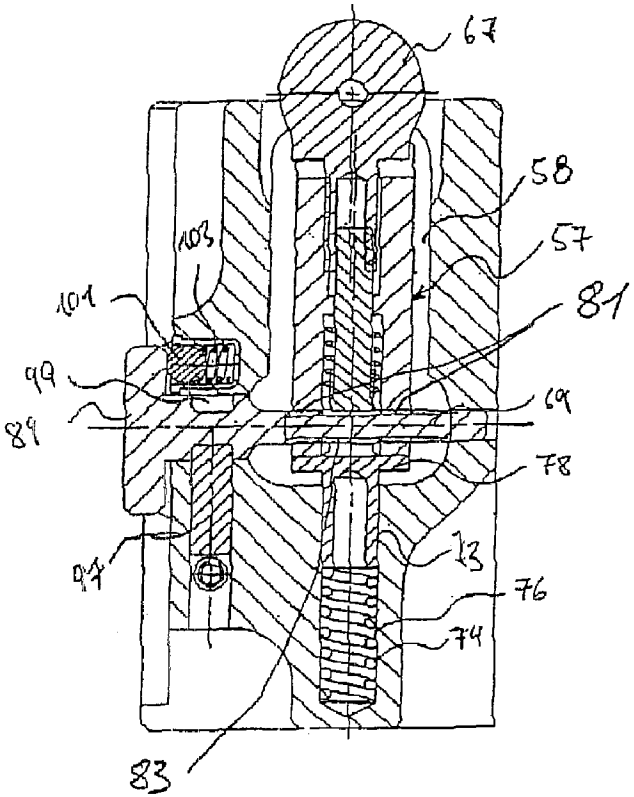
FIG. 17*b* shows a sectional view of the example arrangement of FIG. 17*a*.

In some examples, the spring 74 protrudes into a guide sleeve 72 of the locking element 73 and is positioned directly on the locking base locking base 78 (FIG. 13), or is positioned on the end of the guide sleeve 72 (FIG. 17*b*). In both designs, the other end of the spring 74 supports itself in the holding fixture 76.

Figure 14:
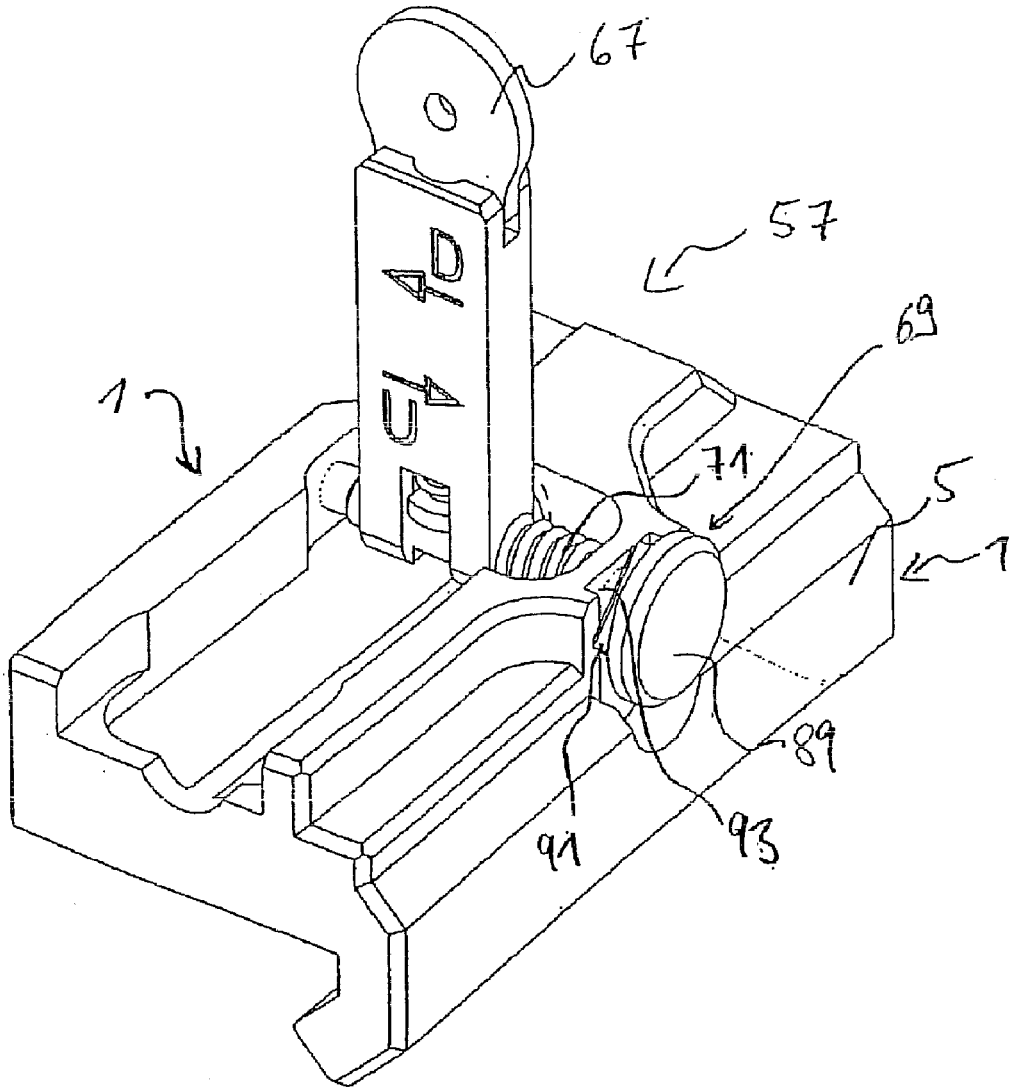
FIG. 14 is a perspective view, similar to the view of FIG. 1, with the example handle released from the locking position for lateral adjustment.

FIG. 14 shows the sight 57 swiveled out during the adjustment operation. For lateral adjustment, the second adjustment element 69 serving as pivoting axis or adjustment axis is pulled out from the connecting piece 1 and rotated (in this example, by about 45°). Behind the handle 89 of the second adjustment element 69, a square formed locking head 91 is arranged, which in this example, can engage in a corresponding recess 93 after torsion by 90°.

If the adjustment element 69 is rotated by less than 90°, the locking head 91 cannot engage in the recess 93 and lies on top. This guarantees an exact incremental lateral adjustment of the sight 57. A spontaneous adjustment is ensured by the cooperation of spring 77, locking head 91 and recess 93.

Figure 16:
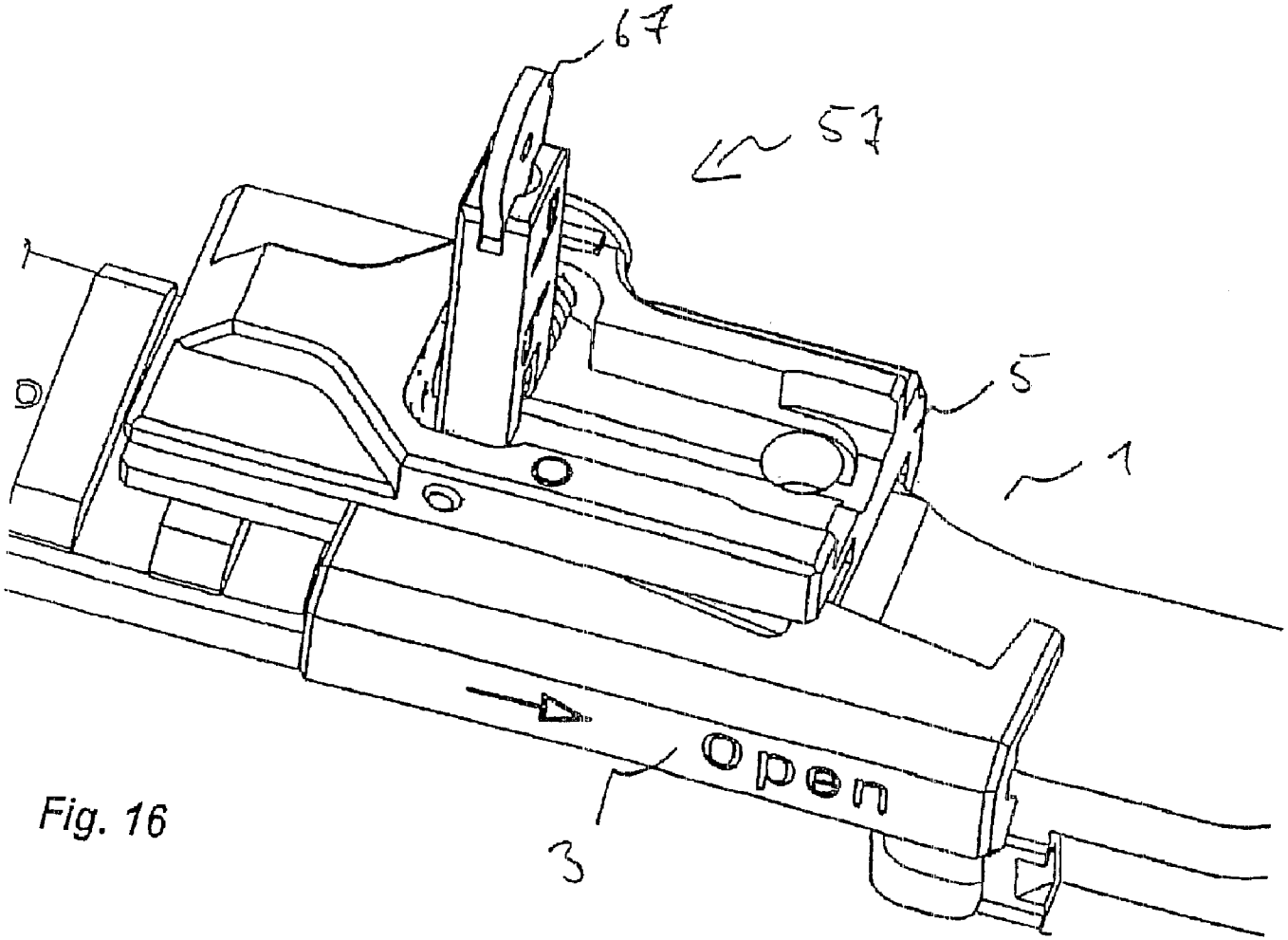
FIG. 16 is a perspective view of the example retaining element in a release position with the example sight in a working position.

FIG. 16 shows a perspective view of the sight 57 in sight position (i.e., working position) with the connecting piece 1. The two retaining elements 3 and 5 are longitudinally displaced to each other for removal from the Picatinny rail 19.

FIGS. 17*a* through 18*b* show alternative examples for lateral adjustment. The sight 57 is shown swiveled in and lies in the recess 58 within the connecting piece 1 in the upper section of the second retaining element 5. The spring-loaded locking element 73 presses with its locking base 78 against the lower end of the sight 57. When the sight 57 is swiveled, the locking base 78 rubs by means of the spring pressure on the sight 57, blocking the swivel movement and exerting an engagement effect. In some examples, there lower end of the sight 57 includes suitable flat surfaces, which define pivoting positions.

Figure 17A:
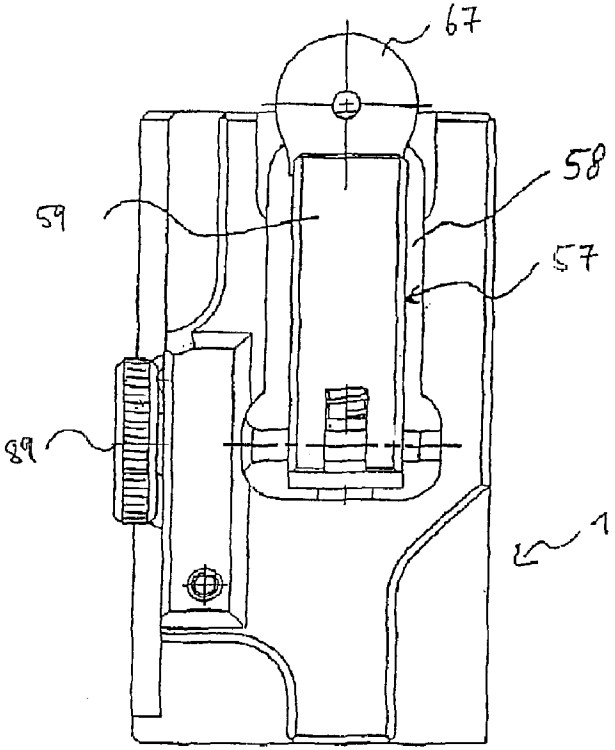
FIG. 17*a* is a top view of an example connecting piece with an alternative adjustment mechanism.

In the example of FIGS. 17*a* and 17*b*, the second adjustment element 69' is axially fixed via a retaining element 97 but is rotatable. The retaining element 97 engages in an annular recess 99 in the second adjustment element 69'. On one end of the second adjustment element 69', an adjustment knob or knurling wheel 89 is constructed, which protrudes laterally from the connecting piece 1. Via the adjustment knob 89, the axially fixed second adjustment element 69' is rotated, and the sight 57 is correspondingly laterally adjusted via the threaded coupling 81, 83. On the internal surface of the adjustment knob 89, a spring-loaded detent ball 101 engages. The detent ball 101 is loaded by a spring 103. On the internal surface of the adjustment knob 89, there are corresponding recesses that correspond to specified torsional positions of the adjustment knob 89 or of the second adjustment element 69' and with it specified lateral positions of the sight 57.

Figure 18B:
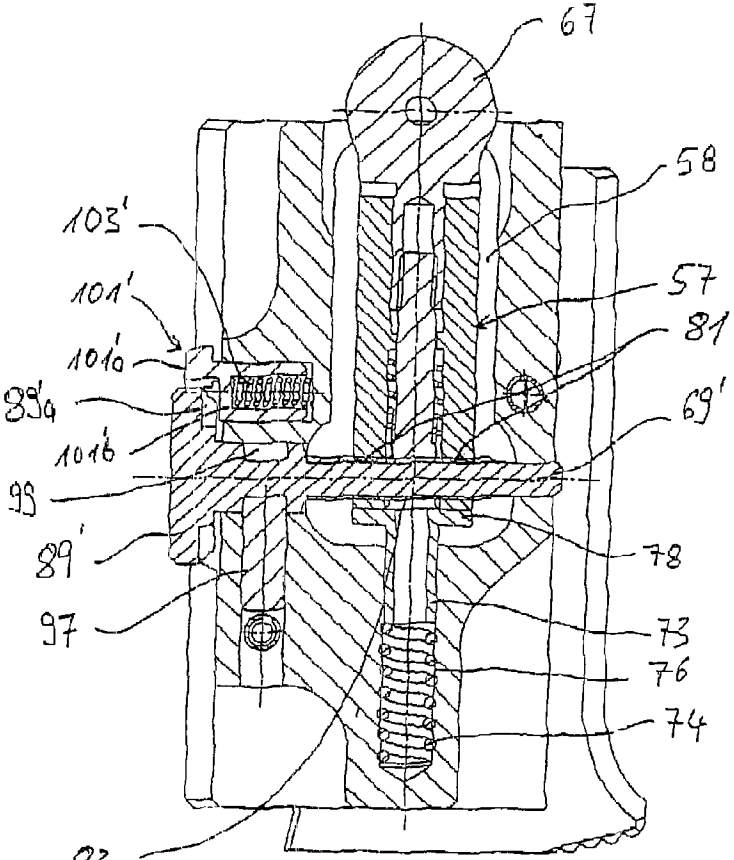
FIG. 18*b* is a sectional view of the example arrangement of FIG. 18*a*.
Figure 18A:
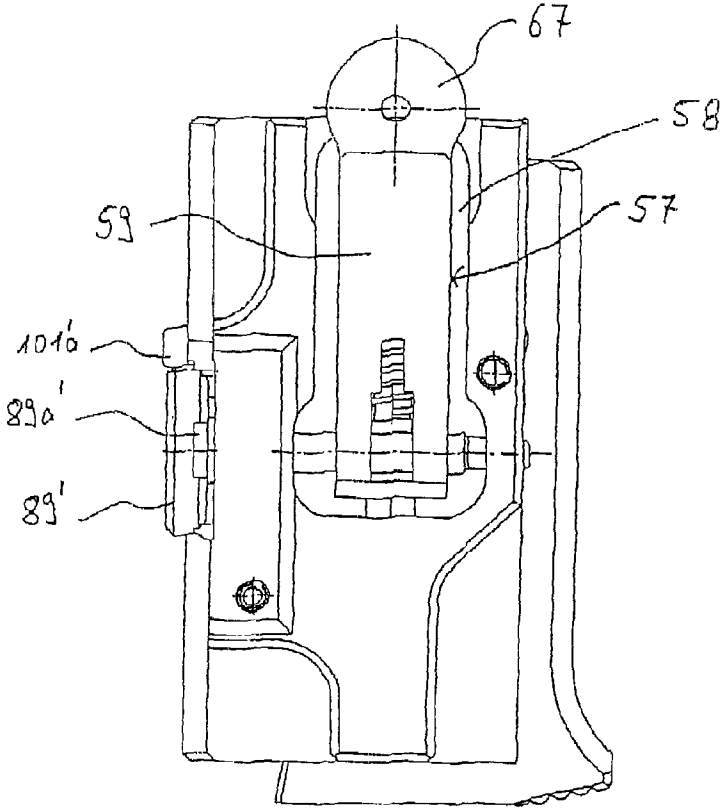
FIG. 18*a* is a top view of an example connecting piece with an additional alternative adjustment mechanism.

FIGS. 18*a* and 18*b* show a different example of the detent mechanism. In this example, a spring-loaded locking bar 101' is constructed in place of the detent ball 101. The locking bar is able to be unlocked via a handle 101*a*' against the spring force of the spring 103' (this position is shown in FIG. 18*b*). In this position, the adjustment knob 89' and with it the second adjustment element 69' can be adjusted. Recesses 89*a*' are provided in the adjustment knob 89'. When the handle 101*a*' is released, a locking section 101*b*' engages the recesses 89*a*'. The adjustment knob 89' is now locked and cannot be accidentally adjusted (this position is shown in FIG. 18*a*). The recesses 89*a*' are constructed in correspondence to particular intervals of rotation of the second adjustment element 69' and permit a lateral adjustment in specified increments.

Figure 19:
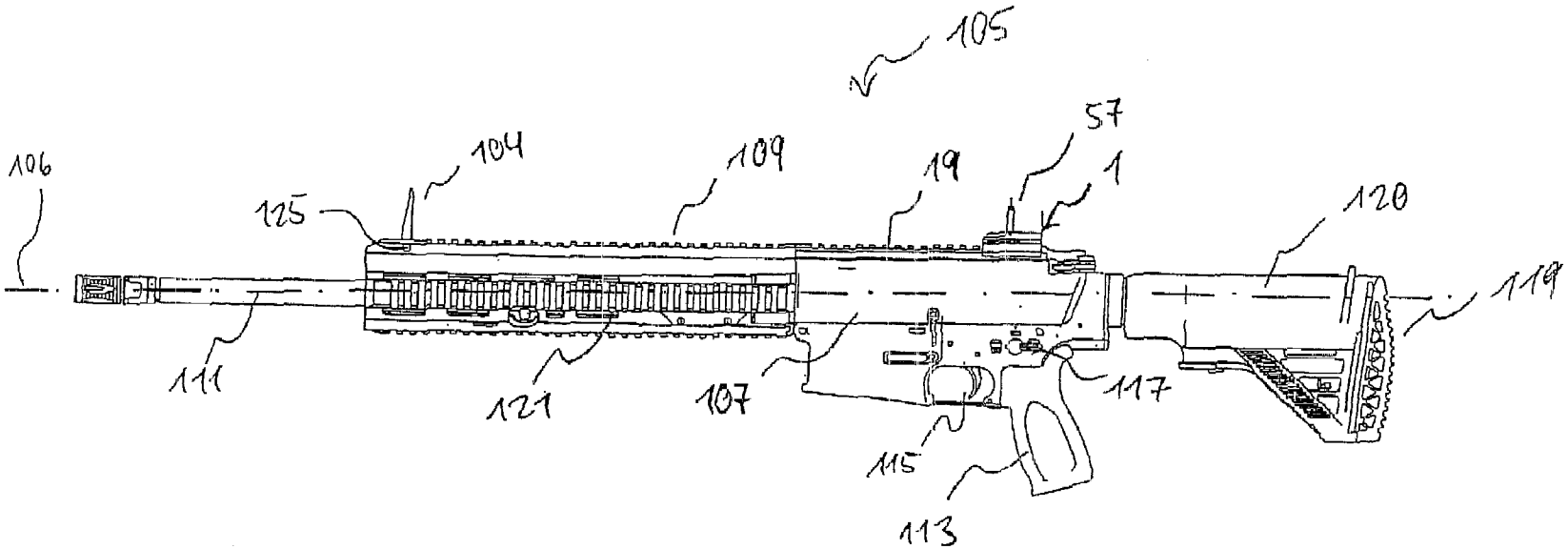
FIG. 19 is a side view of an example weapon with a plurality of example sighting devices and an example connecting piece.

FIG. 19 shows a lateral view of an example weapon 105 with an example connecting piece 1 including a first example sight 57, which is arranged on the Picatinny rail 19 fastened on a housing 107. A second example sight 104 is fastened directly on a hand guard 109. Further, the weapon 105 includes a scope 111, a grip 113 and a trigger 115, above which a safety lever 117 is arranged. On the rear end, on the side averted from the scope end, a shoulder support shoulder support 119 is located on a shaft 120. A hand guard 109 is parallel to the barrel, and an additional Picatinny rail 121 is arranged laterally.

The example sights 57, 104 are shown swiveled out and the longitudinal axes of the connecting piece 1 and of the Picatinny rail 19 run parallel to the axis of the bore 106 of the weapon 105.

The second sight 104, shown in greater detail in FIGS. 20-23, includes a front sight 129 and is pivotable around a pivoting element 125, which defines the pivoting axis. The pivoting element 125 can for example be constructed as a pin or bolt. The front sight 129 is swiveled into the hand guard 109 (i.e., the unused position) and positively terminates with the hand guard 109. The further course of the hand guard 109 is constructed on its upper side as a Picatinny rail 19. The sight 104 also includes a carrier region 127, which on its upper end bears the front sight 129 arranged within a ring 131.

Figure 20:
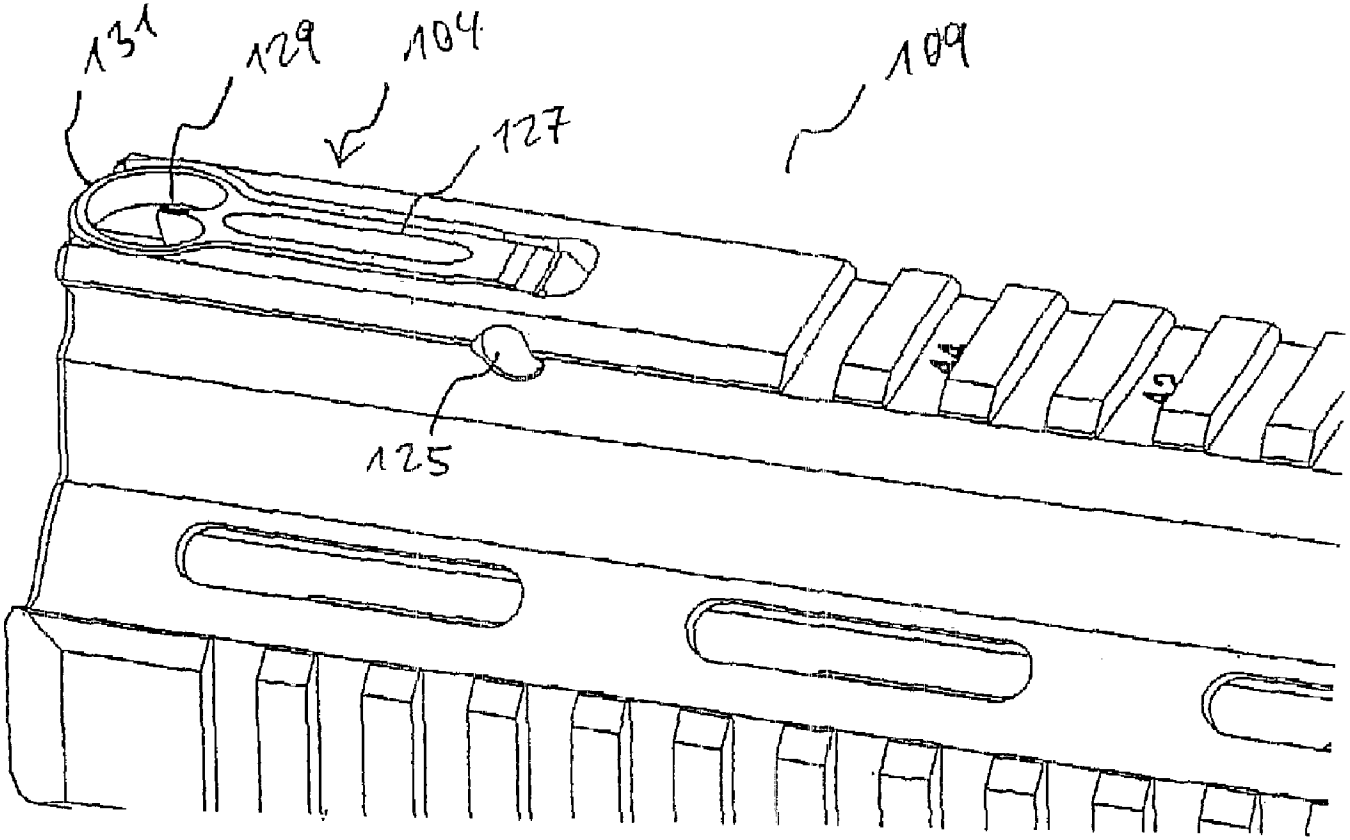
FIG. 20 is a perspective view of a second example sight in an unused position.

When the sight 104 is swiveled in (i.e., in the unused position), the upper end of the sight 104 (i.e., the ring 131) protrudes slightly above the hand guard 109 (see FIG. 20). With this protrusion, the sight 104 is operable and can, for example, be seized by a marksman and swiveled.

Figure 21:
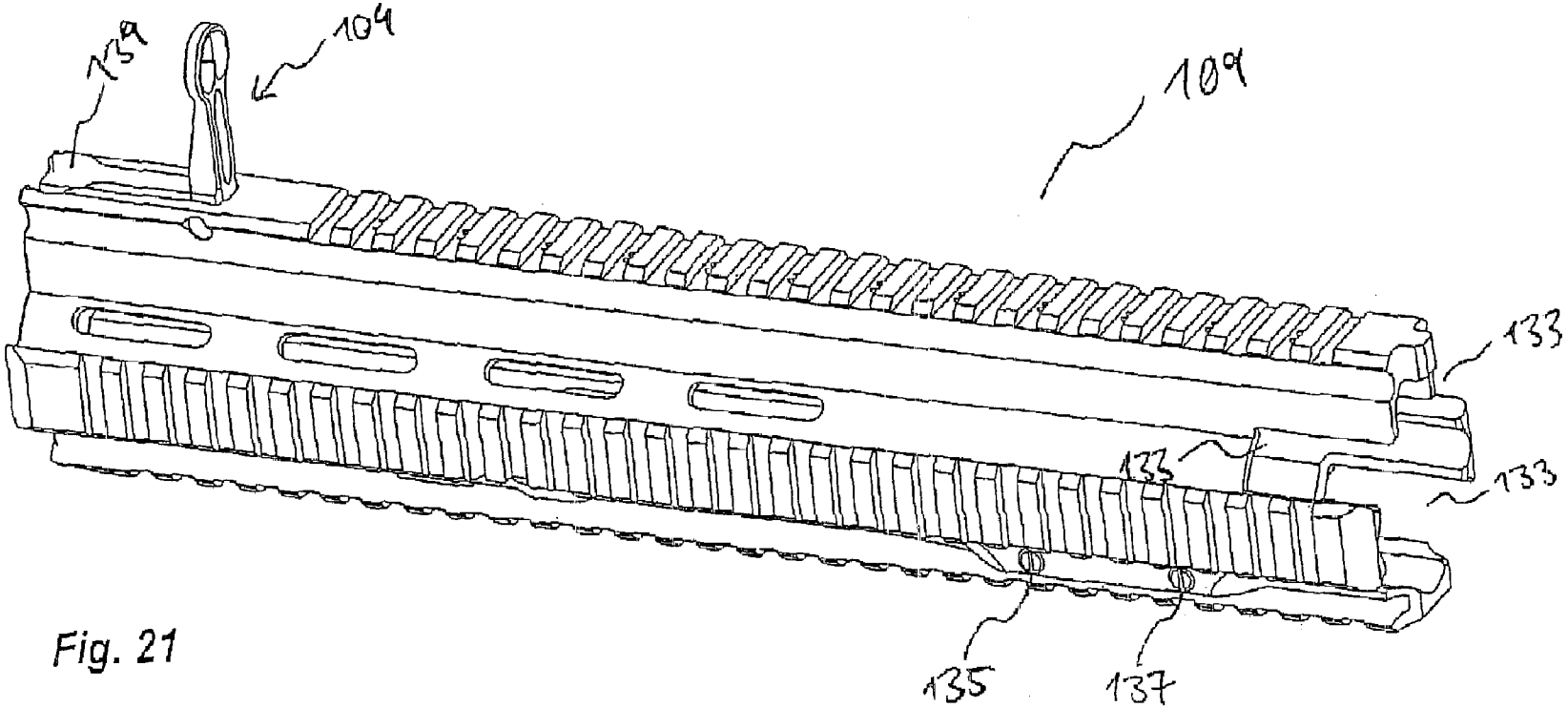
FIG. 21 is a perspective view of an example hand guard with the example sight of FIG. 20 in a working position.

FIG. 21 shows the sight 104 swiveled out (i.e., in the working position), which is above the scope 111 (FIG. 19). The rear end of the hand guard 109 has four recesses 133 extending in longitudinal direction of the hand guard 109. These recesses 133 engage the housing 107, wherein the hand guard 109 is firmly connected to the housing 107 by means of two fastening elements 135, 137 and is aligned to the weapon 105. The fastening elements 135, 137 can be screws, bolts, rivets or other fastening elements. Further, the example recess 139 is depicted with a counter-profile for the holding fixture of the sight 104.

Figure 22:
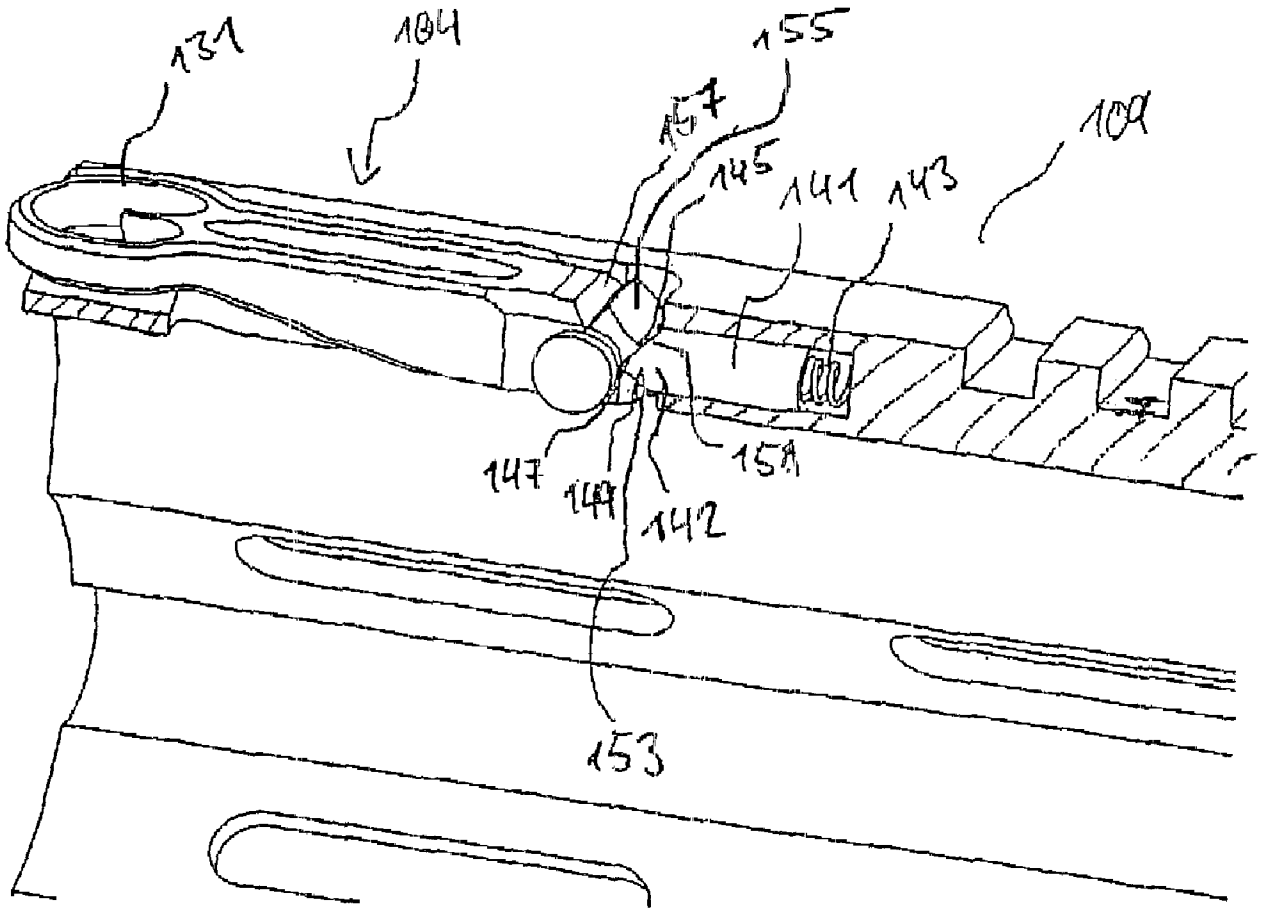
FIG. 22 is a cross-sectional view of the example arrangement of FIG. 2 with an exposed example safety mechanism.

FIG. 22 shows the swivel mechanism of the sight 104. A safety element 141 extends in longitudinal direction on the front end of the hand guard 109 a safety element 141 extends in longitudinal direction. The safety element is pre-tensioned by a spring element 143 such as, for example, a helical spring. In this example, the safety element 141 is constructed as a bolt and has a wedge-shaped, front end 142. The front end 142 engages in a recess 145 on the lower end of the sight 104 to prevent the sight 104 from being unintentionally swiveled in or out. When the sight 104 is swiveled out, a contact surface 147 of the recess 145 acts on a corresponding wedge surface 151 of the wedge-shaped end 142 and displaces the bolt 141 in the direction of the spring element 143. In the process, the contact surface 149 of the recess 145 goes out of engagement with wedge surface 153 of the wedge-shaped end 142. The safety element 141 is pushed back against the spring 143 until it glides on the gliding surface 155.

Adjacent to the gliding surface 155 is a second recess 157 that has a wedge-shaped counter-profile. While the second sight 104 approaches its vertical working position, the safety element 141 glides on the gliding surface 155 with its wedge-shaped end 142 into the second recess 157. When the sight 104 is in the working position, the safety element 141 goes into a positive with the counter-profile of the recess 157 and fixes the sight 104 in the working position against unintentional swiveling in.

Figure 23:
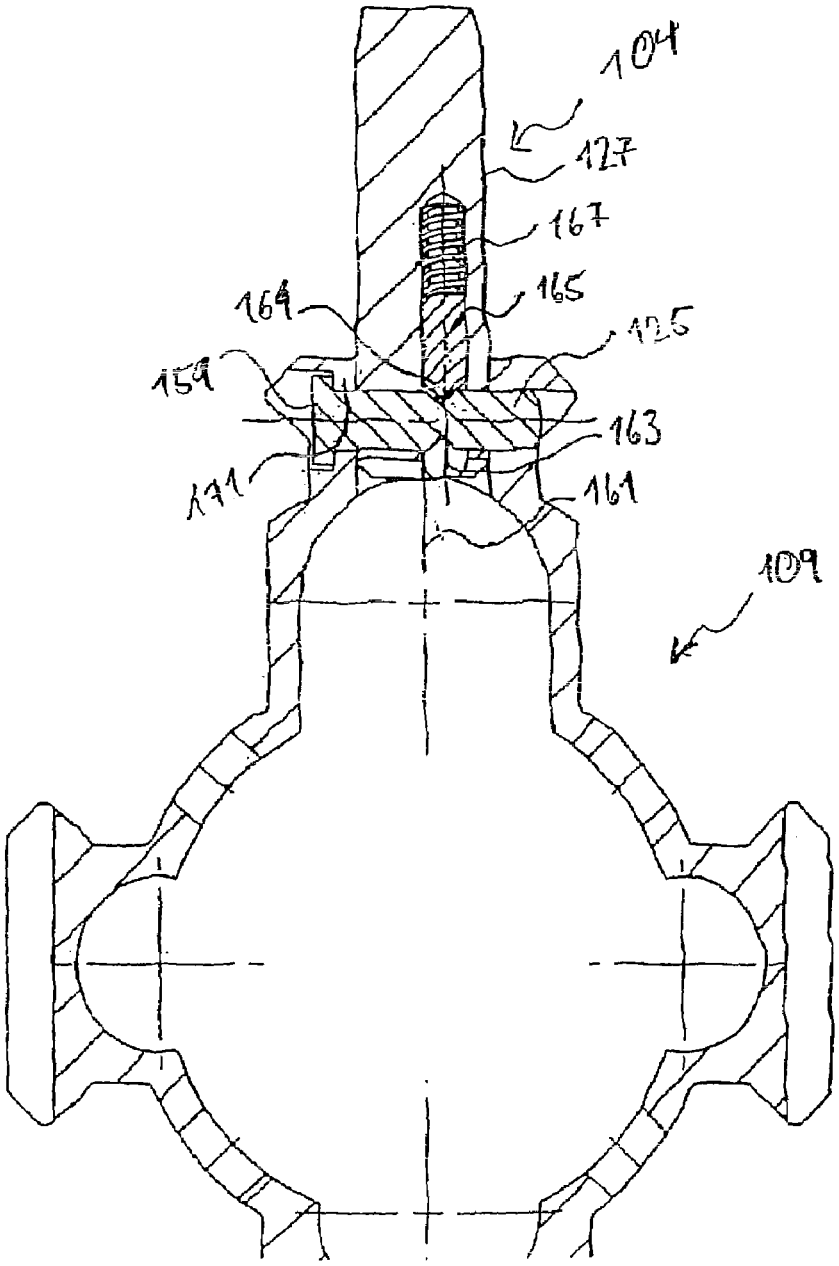
FIG. 23 is a perspective view of the second example sight in partial section with an example exposed locking mechanism.

FIG. 23 shows the lateral locking of the sight 104. The swivel bolt or pivot element 125 includes an annular head 159 (on the left in this example). A wedge-shaped, rotating snap ring groove 163 is included on the shaft of the swivel bolt 125. In the carrier region 127 of the sight 104, a safety element 165 extends in longitudinal direction. The safety element is pre-tensioned by a spring element 167 such as, for example, a helical compression spring.

The safety element 165 and the spring element 167 run in a hollow guiding space. The safety element 165 has a wedge-shaped end region 169 that engages in the snap ring groove 163 in the swivel bolt 125 and, thus, pulls the bolt 125 with the head 159 against a stop 171 and simultaneously causes a lateral locking of the sight 104. This results from the wedge tip 169 being laterally offset to the notch root of the rotating snap ring groove 163 (to the right in FIG. 23). A wedge flank (in FIG. 23, on the right) engages on the corresponding counter-flank of the snap ring groove 163 and pulls the swivel bolt 125 on the shaft with its head against the stop 171. Simultaneously, the sight 104 with the side of the carrier region 127 (in FIG. 23, on the left) is pressed on the other side of the stop 171. As a result, when in the working position, the sight 104 always occupies a defined lateral position to the axis of the bore 106 of a weapon (and in regard to the hand guard 109).

As described herein, the example connecting piece 1 can be designed in combination with the example sight 57. However, in other examples, the connecting piece 1 can additionally or alternatively hold other attachments not shown. The connecting piece 1 can also connect to other objects and facilities (not shown) as weapons. This is particularly the case whenever it is desirable to place the connecting piece 1 on a profiled rail from the side without it being necessary to slip the connecting piece 1 on from the ends.

The illustrated example sight 57 can either be arranged on the example connecting piece 1 or additionally or alternatively above another suitable connecting piece on a weapon. The sight 57 can be designed as a rear sight element or a front sight element. Likewise, the example sight 104, which along with the illustrated arrangement on a hand guard 109 can be arranged above a connecting piece 1 and/or also directly on a weapons component (for example weapon scope, weapons housing) and as a front or rear sight.

The examples described herein provide an improved fastening element in the form of a connecting piece for fastening to a profiled rail that can be mounted quickly and easily as well as being easily detachable and giving a secure support. Further, as described herein, an improved adjustable sight is provided, which ensures the desired sighting and aiming accuracy.

As described herein, the example fastening element or connecting piece 1 has a coupling of the retaining elements 3, 5 by means of the guide slot 41, which is designed in such a way that when one of the two retaining elements 3, 5 is displaced in the longitudinal direction of the profiled rail 19, the elements 3, 5 are also moved obliquely, following the course of the slot 41. In addition, in some examples, the example connecting piece 1 has an adjustment element 69 that is releasably fixed in the sighting position in relation to the sight 57 by means of a detent mechanism and is able to be moved into various sight positions in the adjustment position. Also, in some examples, the example connecting piece 1 includes the second sight 104 mounted on the hand guard 109 with a safety element 141 that fixes the sight 104 in the working position against a stop, transversely to the axis of the bore 106. Furthermore, the example connecting piece 1 described herein can be used on a variety of fastening devices, in particular with profiled rails of all types. And the example connecting piece 1 is suitable for fastening on all types of weapons: handheld firearms; weapons mounted on gun carriages; automatic, semi-automatic, small caliber, large caliber weapons; assault weapons, machine guns, automatic pistols, repeating weapons; light automatic cannons or grenade launchers, etc. Similarly, the example sights described herein may be mounted directly on one of the above named weapons and used therewith. Such sights are also suitable for other weapons that are not firearms such as, for example, a crossbow and similar systems.

The example connecting piece 1 described herein may also be mounted on a dovetail profile of a profiled rail. For this mounting, the engagement profile of the connecting piece 1 is extendable via an obliquely arranged slide link so that when the retaining elements 3, 5 are in the release position, the connecting piece 1 can be fixed on the dovetail profile obliquely to the longitudinal axis of the profiled rail. There the connecting piece 1 occupies its working position, in which the connecting piece 1 engages with its retaining elements 3, 5 on the receiving regions of the profiled rail.

As described above, the retaining elements 3, 5 are coupled by means of the guide slot 41 and are displaced in the longitudinal direction of the profiled rail 19. The elements 3, 5 also can move obliquely, following the course of the slot 41. This allows the connecting piece to be fixed easily because the inner diameter is greater than the outer circumference of the profiled rail 19. The example connecting piece 1 can, thus, be placed on or removed from the profiled rail 19 quickly and easily. A combination of the connecting piece 1 with the sight 57 also enables the respective sighting distance to be adjusted quickly and easily.

In some examples, the retaining elements 3, 5 of the connecting piece 1 are held in the working position by means of the spring element 13 such as, for example, a helical compression spring and/or other elastic elements. Thus, the fixing of the connecting piece 1 on the profiled rail 19 is ensured without further actions. Further, in some examples, the two retaining elements 3, 5 can be coupled to each other by means of random coupling mechanisms. For example, the retaining elements 3, 5 may be arranged and designed in such a way that one of the retaining elements has a recess, into which a corresponding projection on the other of the retaining elements engages in the manner of a tongue and groove guide. Such a guide facilitates a sufficient stability of the fixture and secures the positions of the retaining elements 3, 5 to each other.

In some examples, the guide slot 41 of the connecting piece 1 includes a groove determining the course of the guide and at least one guide element engaging with the guide slot 41. The guide slot 41 may run slanted, linear and/or (in sections) curved. Further, the guide slot 41, in some examples, may run obliquely to the longitudinal axis and outline a straight guideway that forms an angle of 2 to 50° to the longitudinal axis. Preferably the angle is 8 to 350° and especially preferably the angle is 8 to 15°. Such a course of the slot 41 ensures that the connecting piece 1 acts self-locking vis-à-vis transverse forces—in dependency on the friction—and cannot be spontaneously displaced in longitudinal direction. Too flat of an angle, on the other hand, aggravates the opening of the connecting piece and can lead to jamming.

As noted above, in some examples, the guide element 43 is a cam and is assigned to the first retaining element 3. The cam 34 can be constructed as a pin, bolt or the like and goes in the guide slot 41, which is constructed as a groove in the second retaining element 5. This facilitates an especially compact and space-saving construction.

In addition, in some examples, the retaining elements 3, 5 of the connecting piece 1 are constructed so the connecting piece 1 is kept in the working position when a force acts on the connecting piece in the direction of the longitudinal axis of the profiled rail 19. Therefore, corresponding recoil effects of the connecting piece 1 are prevented from loosening the connecting piece 1.

The connecting piece 1, in some examples, includes the handle 12 arranged on one of the retaining elements 3, 5, which can be used to bring the connecting piece 1 into the release position. The handle 12 may be constructed in one piece as a projection or may be mounted on the connecting piece 1. Furthermore, the handle 12 can be screwed on, riveted, adhered or otherwise fastened and can be made of the same material as the connecting piece 1 or also of another suitable material. In some examples, the handle 12 is of the same material and is one-piece with the connecting piece 1, for example co-extruded and cut out later.

Additionally, in some examples, the receiving regions 21 of the retaining elements 3, 5, can be arranged on the profiled rail 19 so their profile tapers obliquely to the longitudinal axis and the retaining elements 3, 5 encompass the profiled rail 19 in the manner of a shoe. Alternatively, the retaining elements 3, 5, in some examples, are arranged at least partially in the manner of a wedge in the profiled rail 19. In both cases, a wedge effect can be achieved by means of a corresponding design of the receiving regions 21, where the wedge effect improves the coupling on the profiled rail 19.

In some examples, the connecting piece 1 includes a formation or projection 15 which can be brought into engagement with a counter-formation arranged in the profiled rail 19. The formation 15 can for example be constructed as a projection, top part, a retaining pin, a set bolt, a screw or the like. The formation 15 engages for example in a recess 37 positioned in the profiled rail 19 or an opening to lock the connecting piece 1 in the profiled rail 19. The formation 15 can be constructed in production as an opening, for example, as a groove or also as a recess, for example as a borehole.

If the formation 15 is a cam-like twist lock and if the counter-formation 37 is a transverse slot in the profiled rail 19 (e.g., a Picatinny rail), the twist lock can engage in the transverse slot 37 and fix the connecting piece 1 in longitudinal direction coaxially to the bore of the axis. Recoil forces of weapons acting in longitudinal direction of the connecting piece 1 then cause a displacement of the connecting piece 1 in longitudinal direction.

If a location hole is constructed in the profiled rail 19, a fastening of the connecting piece 1 is only possible on one area of the profiled rail 19. For example, a guard can only be arranged on a defined position even in the case of poor visibility conditions. This is in particular helpful in the case of Picatinny rails, which have many transverse slots. Additionally, such a borehole with a transverse offset can be arranged to the longitudinal axis so that the connecting piece 1 can only be fixed on the profiled rail 19 in defined direction.

As noted above, in some examples, the connecting piece 1 includes the sight 57. Any other add-on devices such as, for example, a sniperscope, can be mounted on the connecting piece 1. The example sight 57 can be produced in one piece with the fastening element or be fastened on the connecting piece 1 (e.g. screwed on, riveted to, adhered to, etc.). Also, elements of the sight 57 can be constructed in one piece on the connecting piece 1 and additional subcomponents of the sight 57 can be fastened on the connecting piece.

The example sight 57 includes, as noted above, the adjustment element 69, which can be moved in opposition to a spring force from a sight position into an adjustment position. The adjustment element 69 is releasably fixed in the sight position in relation to the sight 57 by means of a detent mechanism and can be moved into various sight positions when in the adjustment position. For example, the line of sight can be adapted to different target distances and the lock of the adjustment elements prevents a spontaneous adjustment of the line of sight.

As noted above, the example sight 57 includes the first and/or second adjustment elements 75, 69. The first adjustment element 75 enables height adjustment of the sight 57. The second adjustment element 69 enables lateral adjustment of the sight 57. Thus, the sight 57 can be adjusted in height or laterally adjusted transversely to the axis of the bore to set a line of sight with an additional sight, for example a front sight.

The first and second adjustment elements 75, 69 each includes the threaded section 79, 83 that cooperates with the corresponding counter-threaded section 80, 81 for adjustment of height and/or lateral adjustment, as described above. Threads are suitable to make the height adjustment and/or lateral adjustment of the sight precisely adjustable by means of thread pitch.

The first and second adjustment elements 75, 69 also each include a handle 67, 89 by means of which the adjustment element 75, 69 can be brought from a sight position into an adjustment position. Via the handle 67, 89, the respective adjustment element 75, 69 can be easily operated. Furthermore, the example handles 67, 89 lock with corresponding counter-formations in the sight 57, that is, the handles 67, 89 are detachable in a positive fit the sight position. This makes possible a precise height and/or lateral adjustment, in the lock of corresponding, defined positions which correspond to a specified height or lateral adjustment of the sight. In addition, this enables a compact construction can be realized.

The example handle 67 of the sight 57 is, as discussed above, constructed as a rear sight notch. The rear sight notch 67 can be constructed as a simple, open rear sight notch or as a diopter sight of any dimension. The peephole of the diopter sight is usually designed with larger dimensions when placed on a system box of a weapon or also further to the front, for example above the cartridge chamber. However, a diopter sight may also be arranged close to the eye of a marksman.

Further the height and/or lateral adjustment of the sight 57 may be at a specified bevel, in particular by 60°, 90° and/or 180°. Defined bevels make possible a coordination of the thread adjustment with the detent mechanism. Thus, a precise setting of a line of sight can be ensured. The first sight is adjustable for height adjustment by means of turning by 180° and may be adapted, for example, when testing a weapon at a distance of 100, 200 or 400 m.

Also, the example sight may be, in some examples, incrementally or progressively height and/or laterally adjustable by means of the first and or second adjustment element 75, 69 by fixed, equal amounts. In this construction, the thread pitch of the lateral and/or height adjustment 69, 75 is assigned to a line of sight. In the case of progressive adjustment, the detent mechanism can be omitted.

The lateral adjustment can include any bevels, and the lateral adjustment may extend by 60° or 90°. Also, in the case of the lateral adjustment, the thread pitch is coordinated on the detent mechanism. Furthermore, in some examples, both the height as well as the lateral adjustment are adjustable counterclockwise or clockwise.

In some examples, the sight can be constructed as a notch or bead arrangement. For example, the sight may be constructed as a rear sight notch when it is supposed to form a line of sight in the rear end and as a bead arrangement when it is supposed to form a line of sight in the front end.

In addition, as discussed above, the handle of the adjustment element is constructed spring-loaded. The spring element can be arranged coaxially to the thread element within a coaxial spring guide, against which it supports itself. The spring element can be constructed as a helical compression spring or as a different elastic element.

For lateral or height adjustment of the sight 57, the spring element acts on the first or second adjustment element 75, 69 so the detent arrangement locks with a counter-formation and is releasable by means of a displacement or removal of the handle of the adjustment element against the spring action from the lock. The handle locks as soon as the user releases it in the respective provided lock position. If the handle is not in the exact position, the handle cannot lock in and therefore is above. This signals a defective setting to the user.

As described above, the sight 57 is adjustable against the spring-loaded locking element 73 from an unused position to a working position. The adjustment takes place around a pivoting axis wherein the pivoting axis coincides with the adjustment axis of the second adjustment element 69. Thus, it requires no additional pivoting elements and an especially compact construction is facilitated. Additionally, the locking element 73 detachably locks the sight 57 in the unused position and in the working position. The sight 57, thus, stably occupies its working or unused position, but can be easily adjusted.

A recess 58 in the connecting piece 1 holds the sight 57 in the unused position. This allows a protected, compact arrangement of the sight 57 in the unused position. Further it is possible to slip on additional devices on a profiled rail 19 or the hand guard 109, for example a weapon, wherein the swiveled sight 57 is not in the way and/or must be removed. The recess 58 can be designed in such a way that the sight 57 is only adjustable in the working position between sight position and adjustment position. Thus unintended lateral or height adjustment of the sight 57 is prevented.

In addition, in some examples, as noted above, the example connecting piece includes the second sight 104. The cooperation of the first and the second sight 57, 104 facilitates the provision of a line of sight.

The second sight 104 can be arranged at random positions on the housing, on the barrel or for example on a mounting rail of the weapon 105. In the case of free-swinging barrels a second shot can be imprecise due to of the barrel oscillations. An arrangement on the housing leads to a relatively short line of sight, in which case the target diagram can shift significantly further than in the case of a long line of sight and, thus, decrease aiming accuracy. Thus, the second sight 104 may be arranged directly on a hand guard 109 of the weapon 105, and an especially long line of sight can be produced.

Further, the second sight 104 can be pivoted about a pivoting element 125 from an unused position into a working position, as described above. The second sight 104, in some examples, includes the second safety element 165 that fixes the sight 104 in the working position against a stop, transversely to the axis of the bore 106. The safety element 165 can be a screw, a locking screw, a spring element or some other detent mechanism.

Further, when the sight 104 is in the working position, the example safety element 165, spring-loadedly engages the second sight 104 on a corresponding formation (e.g., a recess) constructed on the pivoting element 125. This formation can be a projection or a recess, which, for example, is milled in or bored. The example safety element 165 is, for example, a spring-loaded bolt.

The wedge-shaped active areas of the recesses 145, 157 and the wedge surfaces 151, 169 permit a precise fixing of the sight 104 without especially high demands having to be made on the shape tolerances and/or positional tolerances in the design of the active areas, which reduces the production costs.

As discussed above, the example safety element fixes the pivoting element 125 in the second sight 104 and prevents its removal. An additional secure retainer, for example a pin may also be included in the design. The pivoting element 125 is fixed in its position and simultaneously prevents a removal or falling out of the structure.

In some example, the sight 104 and pivoting element 125 occupy a defined reference position to the axis of the bore. The line of sight can be set with repeatable accuracy and reproducibly.

Additionally, the sight 104 can be pivoted against the spring-loaded locking element around the pivoting axis from the unused position into the working position. In the process the locking element detachably locks the sight 104 by means of a detent mechanism in the unused position and in the working position. This prevents an unintended pivoting/deviation of the sight 104.

The sight 57, 104 can be pivoted by 90° and in its unused position rest upon on the weapon 61, 105 or the hand guard 109 or be concealable there in a recess 58, 157. The example connecting piece 1 or the hand guard 109 includes the recess 58, 157 in which the sight 57, 104 is concealable in the unused position, which facilitates a compact construction. Furthermore, add-on devices can be slipped on the Picatinny rail 19 of the weapon 651, 105 or on another profiled rail 19 in the case of a pivoted sight 57, 104. Further the pivoted sight 57, 104 can be protected from damages when not in use.

In some examples, the second sight 104 can be constructed as a notch arrangement or as a bead arrangement. Furthermore, in some examples, the hand guard 109 may include the example connecting piece 109 and, in other examples, the weapon 61, 105 may include the example connecting piece 1 without a hand guard 109.

Further examples and variations of the examples described herein are considered by this disclosure. For example, any example or portion thereof described herein may be combined with any other example or portion thereof. For example, the features of the first sight 57 may be included in the second sight 104 and vice versa. Also, although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A connecting piece couplable to a rail of a weapon, the connecting piece comprising:

a first retaining element including a first receiving region configured to engage a corresponding first counterface of the rail;

a second retaining element including a second receiving region configured to engage a corresponding second counterface of the rail; and a guide slot running diagonally to a longitudinal direction of the rail via which the first retaining element and the second retaining element are coupled, when one of the two retaining elements is displaced in the longitudinal direction of the rail, at least one of the first retaining element or the second retaining element moves obliquely relative to the other of the first retaining element or the second retaining element following the orientation of the guide slot to move the connecting piece between a working position in which the first receiving region is engaged with the corresponding first counterface and the second receiving region is engaged with the second counterface to a release position in which both the first receiving region and the second receiving region are not engaged with the corresponding first counterface and the second counterface, respectively.

2. A connecting piece as defined in claim 1 further comprising a spring element configured to hold the first retaining element and the second retaining element in the working position.

3. A connecting piece as defined in claim 1, where the first retaining element includes a recess which a corresponding projection on the second retaining element engages.

4. A connecting piece as defined in claim 1, where the guide slot includes a groove and at least one guide element.

5. A connecting piece as defined in claim 4, where the guide element is a cam associated with the first retaining element and is coupled by the groove with the second retaining element.

6. A connecting piece as defined in claim 1 that is kept in the working position when a force acts on the connecting piece in the longitudinal directional of the rail.

7. A connecting piece as defined in claim 1 further comprising a handle coupled to one of the first retaining element or the second retaining element that is configured to move the connecting piece to the release position.

8. A connecting piece as defined in claim 1, where the first retaining element and the second retaining element encompass the first counterface and the second countersurface, respectively, in the manner of a shoe.

9. A connecting piece as defined in claim 1, where the first retaining element and the second retaining element encompass the first counterface and the second countersurface, respectively, in the manner of a wedge.

10. A connecting piece as defined in claim 1 further comprising a formation configured to engage a counter-formation of the rail.

11. A connecting piece as defined in claim 1, where the rail is a Picatinny rail.

12. A connecting piece as defined in claim 10, where the formation is a twist lock and the counter-formation is a transverse slot.

13. A connecting piece as defined in claim 1 further comprising a sight.

14. A connecting piece as defined in claim 13, where the sight includes an adjustment element that is movable, in opposition to a spring force, from a sight position into an adjustment position, the adjustment element being releasably fixed in the sight position in relation to the sight by a detent mechanism and moveable into a plurality of sight positions in the adjustment position.

15. A connecting piece as defined in claim 13, where the sight includes a second adjustment element.

16. A connecting piece as defined in claim 13, where the adjustment element is a height adjustment element configured to adjust the height of the sight.

17. A connecting piece as defined in claim 13, where the adjustment element is a lateral adjustment element configured to adjust the lateral position of the sight.

18. A connecting piece as defined in claim 15, where the adjustment element is a height adjustment element to adjust the height of the sight and the second adjustment element is a lateral adjustment element to adjust the lateral position of the sight.

19. A connecting piece as defined in claim 15, where the adjustment element and the second adjustment element each have a threaded section configured to cooperate with a corresponding counter-threaded section for adjustment of height and/or lateral adjustment.

20. A connecting piece as defined in claim 15, where the adjustment element and the second adjustment element each have a handle configured to bring the adjustment element and the second adjustment element from the sight position to the adjustment position, and a detent formation configured to releasably lock the adjustment element and the second adjustment element in the sight position.

21. A connecting piece as defined in claim 20, where the handle is a rear sight notch.

22. A connecting piece as defined in claim 14, where adjustment element includes specified bevels of 60°, 90° and/or 180°.

23. A connecting piece as defined in claim 14, where the sight is incrementally or progressively height and/or laterally adjustable by the adjustment element by fixed, equal amounts.

24. A connecting piece as defined in claim 13, where the sight is a notch arrangement or a bead arrangement.

25. A connecting piece as defined in claim 14, where the adjustment element is spring-loaded and unlockable against the spring force for lateral or height adjustment of the sight.

26. A connecting piece as defined in claim 13 further comprising a spring-loaded locking element against which the sight is adjustable from an unused position to a working position.

27. A connecting piece as defined in claim 25, where the sight is pivotable around a pivoting axis from an unused position to a working position, the pivoting axis corresponds to an adjustment axis of the adjustment element.

28. A connecting piece as defined in claim 26, where the locking element is configured to detachably lock the sight in the unused position and in the working position.

29. A connecting piece as defined in claim 26 further comprising a recess configured to hold the sight in the unused position.

30. A connecting piece as defined in claim 13 further comprising a second sight.

31. A connecting piece as defined in claim 30, where the second sight is mountable directly on a hand guard of the weapon.

32. A connecting piece as defined in claim 30, where the second sight is pivotable about a pivoting element from an unused position into a working position, and the second sight has a safety element that fixes the sight in the working position against a stop transversely to an axis of a bore of the weapon.

33. A connecting piece as defined in claim 32, where in the working position, the safety element engages a recess on the pivoting element.

34. A connecting piece as defined in claim 33, where the safety element and the pivoting element each have wedge-shaped active areas that engage in the working position.

35. A connecting piece as defined in claim 32, where safety element fixes the pivoting element with regard to the sight.

36. A connecting piece as defined in claim 32, where, in the working position, the sight and the pivoting element each occupy a defined reference position to the axis of the bore.

37. A connecting piece as defined in claim 32, where the sight is pivotable against a spring-loaded locking element around a pivoting axis from the unused position into the working position.

38. A connecting piece as defined in claim 37, where the locking element is configured to detachably lock the sight by a detent mechanism in the unused position and in the working position.

39. A connecting piece as defined in claim 31 further comprising a recess in which the sight is concealable in the unused position.

40. A connecting piece as defined in claim 31, where the second sight is a notch arrangement or as a bead arrangement.

41. A hand guard for a weapon with a connecting piece, the connecting piece comprising:

a first retaining element including a first receiving region configured to engage a corresponding first counterface;

a second retaining element including a second receiving region configured to engage a corresponding second counterface; and a guide slot running diagonally to a longitudinal direction of the rail via which the first retaining element and the second retaining elements are coupled, when one of the two retaining elements is displaced in the longitudinal direction of the hand guard, at least one of the first retaining element or the second retaining element moves obliquely relative to the other of the first retaining element or the second retaining element following the orientation of the guide slot to move the connecting piece between a working position in which the first receiving region is engaged with the corresponding first counterface and the second receiving region is engaged with the second counterface to a release position in which both the first receiving region and the second receiving region are no engaged with the corresponding first counterface and the second counterface, respectively.

42. A weapon with a connecting piece, the connecting piece comprising:

a first retaining element including a first receiving region configured to engage a corresponding first counterface;

a second retaining element including a second receiving region configured to engage a corresponding second counterface; and a guide slot running diagonally to a longitudinal direction of the rail via which the first retaining element and the second retaining elements are coupled, when one of the two retaining elements is displaced in the longitudinal direction of the weapon, at least one of the first retaining element or the second retaining element moves obliquely relative to the other of the first retaining element or the second retaining element following the orientation of the guide slot to move the connecting piece between a working position in which the first receiving region is engaged with the corresponding first counterface and the second receiving region is engaged with the second counterface to a release position in which both the first receiving region and the second receiving region are no engaged with the corresponding first counterface and the second counterface, respectively.

* * * * *